US006997680B2

(12) United States Patent
Shapiro et al.

(10) Patent No.: US 6,997,680 B2
(45) **Date of Patent: *Feb. 14, 2006**

(54) HOME COMFORT DEVICE

(75) Inventors: Barry Shapiro, Doylestown, PA (US); William E. Lasko, Chester Springs, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 51 days.

This patent is subject to a terminal disclaimer.

(21) Appl. No.: 10/720,374

(22) Filed: Nov. 24, 2003

(65) Prior Publication Data

US 2004/0120822 A1 Jun. 24, 2004

Related U.S. Application Data

(63) Continuation-in-part of application No. 10/431,964, filed on May 8, 2003.

(51) Int. Cl.
*F04D 29/00* (2006.01)

(52) U.S. Cl. ..... 416/100; 416/246

(58) Field of Classification Search ..... 416/244 R, 416/246, 79, 100, 108, 109, 187; 415/53.1, 415/175, 203, 206, 224
See application file for complete search history.

(56) References Cited

U.S. PATENT DOCUMENTS

| | | | | |
|---|---|---|---|---|
| 1,429,130 | A | 9/1922 | Dutton | |
| 2,255,759 | A | 9/1941 | Carpenter | |
| 2,471,784 | A | 5/1949 | Seifner et al. | |
| 2,824,429 | A | 2/1958 | Zucker | |
| 3,175,550 | A | 3/1965 | Knapp | |
| 3,251,540 | A | 5/1966 | Kinsworthy | |
| 3,267,255 | A | 8/1966 | Schultz | |
| 3,290,112 | A | 12/1966 | Gillenwater et al. | |
| 3,575,582 | A | 4/1971 | Covault | |
| 3,725,640 | A | 4/1973 | Kunz | |
| 4,743,739 | A | 5/1988 | Tateishi | |
| 4,900,898 | A | 2/1990 | Kling | |
| 5,083,011 | A | 1/1992 | Munroe | |
| 5,266,004 | A * | 11/1993 | Tsumurai et al. | 416/100 |
| 6,079,949 | A | 6/2000 | Litvin | |
| 6,183,204 | B1 * | 2/2001 | Chang | 416/246 |
| 6,321,034 | B2 | 11/2001 | Jones-Lawlor et al. | |
| RE37,642 | E | 4/2002 | Goldstein | |
| 6,480,672 | B1 | 11/2002 | Rosenszweig et al. | |
| 2002/0034442 | A1 * | 3/2002 | Escobar et al. | 416/205 |

FOREIGN PATENT DOCUMENTS

| | | |
|---|---|---|
| DE | 863 112 C | 1/1953 |
| EP | 0 417 309 A1 | 3/1991 |
| FR | 993168 | 10/1951 |
| FR | 1502108 A | 11/1967 |

* cited by examiner

*Primary Examiner*—Edward K. Look
*Assistant Examiner*—Richard A. Edgar
(74) *Attorney, Agent, or Firm*—Woodcock Washburn LLP

(57) ABSTRACT

The present invention is a space saving home comfort device comprising a housing and an air generator. A support member has a predetermined length and a base member has a maximum width dimension BB. A predetermined rise height R provides support and elevation to the housing. The housing is either fixedly or rotatably coupled to an end of the support member and comprises at least one wall having a predetermined length L and a maximum cross-sectional width D taken along a horizontal plane, at least one inlet opening formed in the at least one wall, at least one outlet opening formed in the at least one wall, and an air generator positioned between the at least one inlet opening and the at least one outlet opening. The air generator provides exhaust air to the at least one outlet opening.

54 Claims, 23 Drawing Sheets

PRIOR ART

HOME COMFORT DEVICE

This application is a Continuation-in-Part of application Ser. No. 10/431,964, filed May 8, 2003.

FIELD OF THE INVENTION

This invention relates to home comfort appliances. More specifically, the present invention relates to a space saving pedestal fan.

BACKGROUND OF THE INVENTION

Pedestal Fans of various sizes have been used for many years. The normal use of a pedestal fan is to provide a cooling sensation to the body. This is accomplished by the current of air generated by the fan or air-moving device passing over the skin of an individual. The current of air that passes over an individual serves to increase the convective heat loss of the body through the natural evaporative process of moisture (e.g. sweat) on the skin. The greater the amount of evaporation the greater the sensation of cooling. The upper portion of the body is more exposed, (head, arms, hands, etc.). This allows the upper portion of the body to experience a greater cooling sensation as the body attempts to naturally dissipate heat through evaporation.

As shown in FIG. 1, the conventional pedestal fan 10 is specifically designed to augment this effect on the upper portion of the body by locating the air generation device at a level above the floor that corresponds to the upper portion of the body. In pedestal fan 10, an air flow 12 is created by axial fan assembly 14 (comprising fan head 16, fan blade 18, front grill 20 and rear grill 22). Axial fan assembly 14 is set above the floor by pedestal 24 and stabilized by base 28 such that air flow 12 can be positioned above the floor to provide comfort to the upper portion of user 26. The exhaust air pattern of a conventional pedestal fan is illustrated in FIG. 17B. A discussion of this pattern in comparison with the present invention is outlined in the detailed description below.

The size of the air delivery device (axial fan assembly 14) in conventional pedestal fan 10 is large due to the diameter of axial blade 18, further requiring additional large guards (grills) 20, 22, to protect the end user 26 from blade 18. In addition, and as shown in FIGS. 2A, 2B and 2C, conventional pedestal fan 10 requires significant oscillation area 29, at least as large, if not larger, than the diameter of the grills 20, 22, so that the cooling effect can be distributed into the living space (not shown). In addition, because of the size and weight distribution of fan assembly 14 and the thrust T (shown in FIG. 1) generated in the direction opposite air flow 12, base 28 must be sufficiently large, (dimension PB) to support fan assembly 14 to prevent tipping. The size of both oscillation area 29 and base 28 require that pedestal fan 10 utilize a large area in the living space.

Another fan that attempts to augment this upper body cooling effect is what is commonly referred to as a conventional tower fan. As shown in FIGS. 3A and 3B, tower fans 30*a*, 30*b* create an elongated air delivery area 32*a*, 32*b* toward a lower portion of user 26 and, thus, are unable to provide a desired cooling effect to the upper body of user 26. The exhaust air pattern of a conventional tower fan is illustrated in FIG. 17C. A discussion of this pattern in comparison with the present invention is outlined in the detailed description below.

Another disadvantage with this type of tower fan is that the long impeller and accompanying housing complicate overall assembly and manufacturing. For example, the long transverse air impeller may have several sections which must be coupled together by glue or ultrasonic welding. This long air impeller assembly must then be balanced to insure correct operation and may also necessitate the use of vibration dampers on the motor. In addition, a long transverse air impeller assembly tends to become misaligned at the top bearing, thereby requiring a special bearing mounted in rubber pads to compensate for this misalignment. The overall weight of the long transverse impeller and accompanying housing create structural and stability problems as height above a mounting surface is increased. The above mentioned problems add significant expense to the manufacturing process and limit the maximum height of the conventional tower fan, which translates into a higher retail price and less than satisfactory performance for the consumer.

In addition to the aforementioned deficiencies, typical conventional pedestal fan 10 requires a significant amount of packaging material as well as space for shipment to the ultimate destination. As shown in FIG. 4A, conventional pedestal fan 10 is shipped to the user in a disassembled form in shipping box 40. Typically, shipping box 40 is stacked with many other shipping boxes 40 on pallet 42 (shown in FIG. 4B) with multiple pallets 42 shipped together in an overland or over water shipping container 44, (shown in FIG. 4C). Due to its large size, the number of pedestal fans 10 that may be contained within shipping container 44 is typically about 864 units.

The packaging of conventional tower fan 30*b* is illustrated in FIG. 5A. Similar to package 40, package 50 containing tower fan 30*b* has a significant volume, albeit slightly less than that of pedestal fan 10. FIGS. 5B and 5C illustrate the shipping efficiency of this configuration, shipping container 44 having a capacity of about 1320 units.

Thus, the costs for shipping of these fan units impact the ultimate price at which a manufacturer may sell his product to a distributor or retailer.

In view of these deficiencies, there is a need for a fan that has a space saving configuration and provides comfort to an upper portion of a user's body.

In addition there is a need for a fan with a simplified construction, which is easily manufactured and reduces the overall cost per unit.

There is also a need for a fan construction which is easily packaged and shipped in a manner that reduces shipping and handling costs per unit.

SUMMARY OF THE INVENTION

In view of the shortcomings of the prior art the present invention is a home comfort device comprising a housing and an air generator; a support member having a predetermined length; a base having a maximum width dimension BB; a predetermined rise height R providing support and elevation to the housing. The housing is either fixedly or rotatably coupled to an end of the support member and comprises at least one wall having a predetermined length L and a maximum cross-sectional width D taken along a horizontal plane, at least one inlet opening formed in the at least one wall, at least one outlet opening formed in the at least one wall, and an air generator positioned between the at least one inlet opening and the at least one outlet opening. The air generator provides exhaust air to the at least one outlet opening.

According to another aspect of the present invention, the support member is comprised of a base for engaging a mounting surface; and a riser having a first end connected to the base and extending upward to a second end.

According to a further aspect of the present invention, the rise height R is at least 12 inches and the overall height is at least 45 inches.

According to still another aspect of the present invention, the maximum cross-sectional width D of the housing is less than about 90% of the longitudinal length L of the housing; and said rise height R is at least 40% of the longitudinal length L of the housing.

According to another aspect of the present invention, the support member is adjustable, allowing for height adjustability of the home comfort device.

According to yet a further aspect of the present invention, a rotator mechanism comprises an oscillator for oscillating movement of said housing relative to said base and about a substantially vertical axis of rotation.

According to another aspect of the present invention, the air generator further comprises a high velocity, low thrust blower assembly; the blower assembly generating a high velocity flow of exhaust air between 400 fpm and 600 fpm when measured 6 feet from the housing. The blower assembly also generates a low thrust of between 0.1 lbs and 0.3 lbs.

According to a further aspect of the present invention, the air generator is a pre-assembled cartridge comprising at least a motor and at least one impeller pre-assembled into a cartridge, the pre-assembled cartridge can be pre-tested before installation into the housing during assembly of the home comfort device

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION

The following description is of a home comfort device that provides an air stream for the purpose of cooling the user. The home comfort device allows the air stream to be directed toward the upper body of the user thus maximizing the desired effect. The device also has a more space saving design than conventional pedestal fans when in use. The construction of the device also achieves a less complicated assembly than the conventional tower fan; and the device has a smaller shipping package and therefore maximizes the shipping space.

The above mentioned characteristics provide the consumer with desirable features and allow the manufacturer to produce the device at a desirable cost.

Figure 6C:
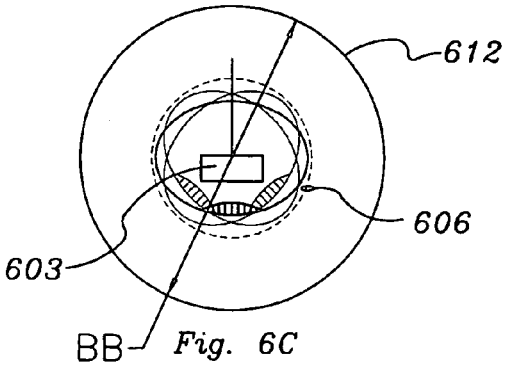
FIGS. 6A, 6B and 6C are views of an exemplary embodiment of the present invention.
Figure 6A:
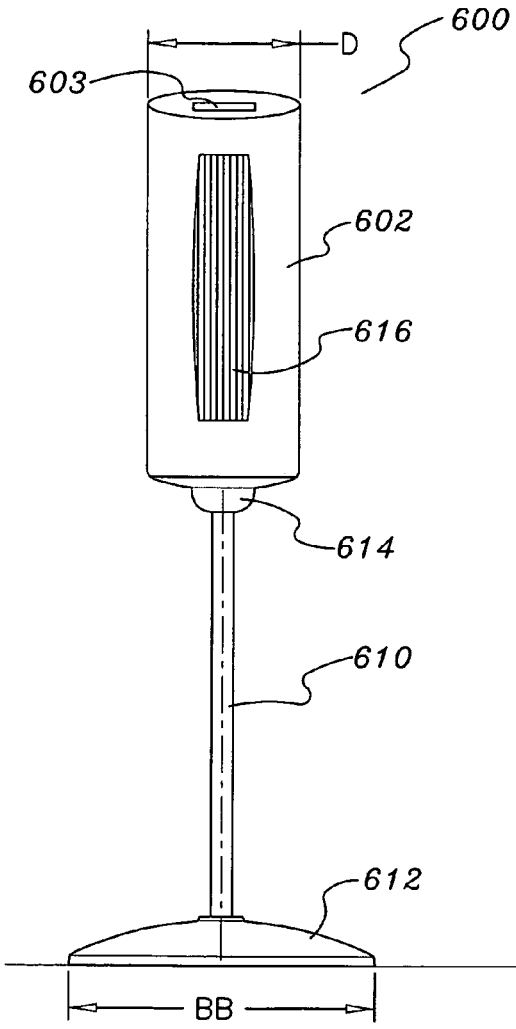
Figure 6B:
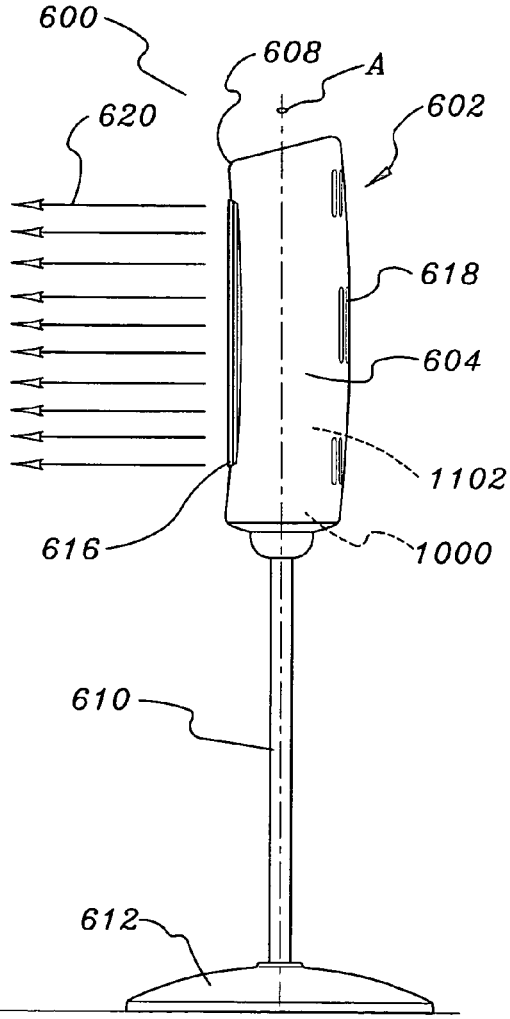

FIGS. 6A, 6B and 6C show an exemplary embodiment of the space saving home comfort device. As shown in FIGS. 6A–6C, home comfort device 600 has a generally elongate configuration and includes housing 602, support column 610 and base 612.

Housing 602 includes at least one outlet opening 616 formed in a front portion of housing 602, and at least one inlet opening 618 preferably formed in a portion of housing 602 rearward of outlet opening 616. Outlet opening 616 may include a grill and/or louvers (either fixed or moveable), for example. Examples of positions for inlet opening 618 are in a rear portion of housing 602 and/or a side portion of housing 602. Support column 610 is connected to a lower portion of housing 602.

Preferably, the housing 602 has an elongated shape including at least one wall 604, a top and a bottom that together define an interior space. As shown in FIGS. 6A and 6B the longitudinal length of the housing 602 is oriented substantially vertical. The configuration of the wall 604 may be such that the housing has a substantially round cross section, for example. The invention is not so limited, however, in that wall 604 may be more than one wall coupled to one another and/or having any of a variety of geometric cross sections, such as a square, an oval, a rectangle, or other polygonal forms. In one exemplary embodiment, wall 604 may be formed from any material that is rigid or self-supporting, such as a polymer for example.

Support column 610 extends vertically down from housing 602. Support column 610 may be formed of metal, polymer or other materials. Support column 610 may comprise more than one component thus allowing for height adjustability, (best described in FIGS. 7A, 7B and 7C). The lower portion of support column 610 is connected to base 612.

Base 612 may be comprised of one or multiple pieces attached to one another having a maximum width dimension BB. Base 612 may be made of materials such as metals or polymers, or a combination of various materials. Base 612 sits on a surface thus allowing the entire structure of home comfort device to be positioned in a substantially vertical, upright and elongated position.

Although the exemplary embodiment shown in FIGS. 6A, 6B and 6C illustrate base 612 and support column 610 as separate pieces, the invention is not so limited. It is contemplated that the support of housing 602 may be accomplished in a variety of ways, such as forming support column 610 and base 612 as a unitary member having a predetermined shape. One non-limiting example of such a shape is a conical shape for example.

Figure 11B:
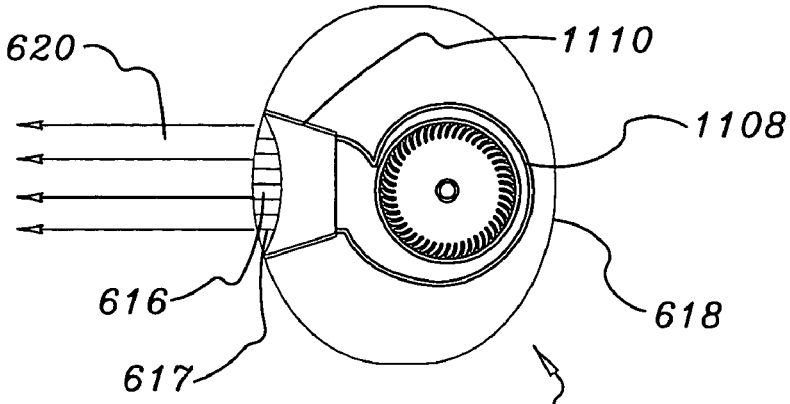
FIGS. 11A and 11B are various cross-sectional views of another exemplary embodiment of the present invention.
Figure 11A:
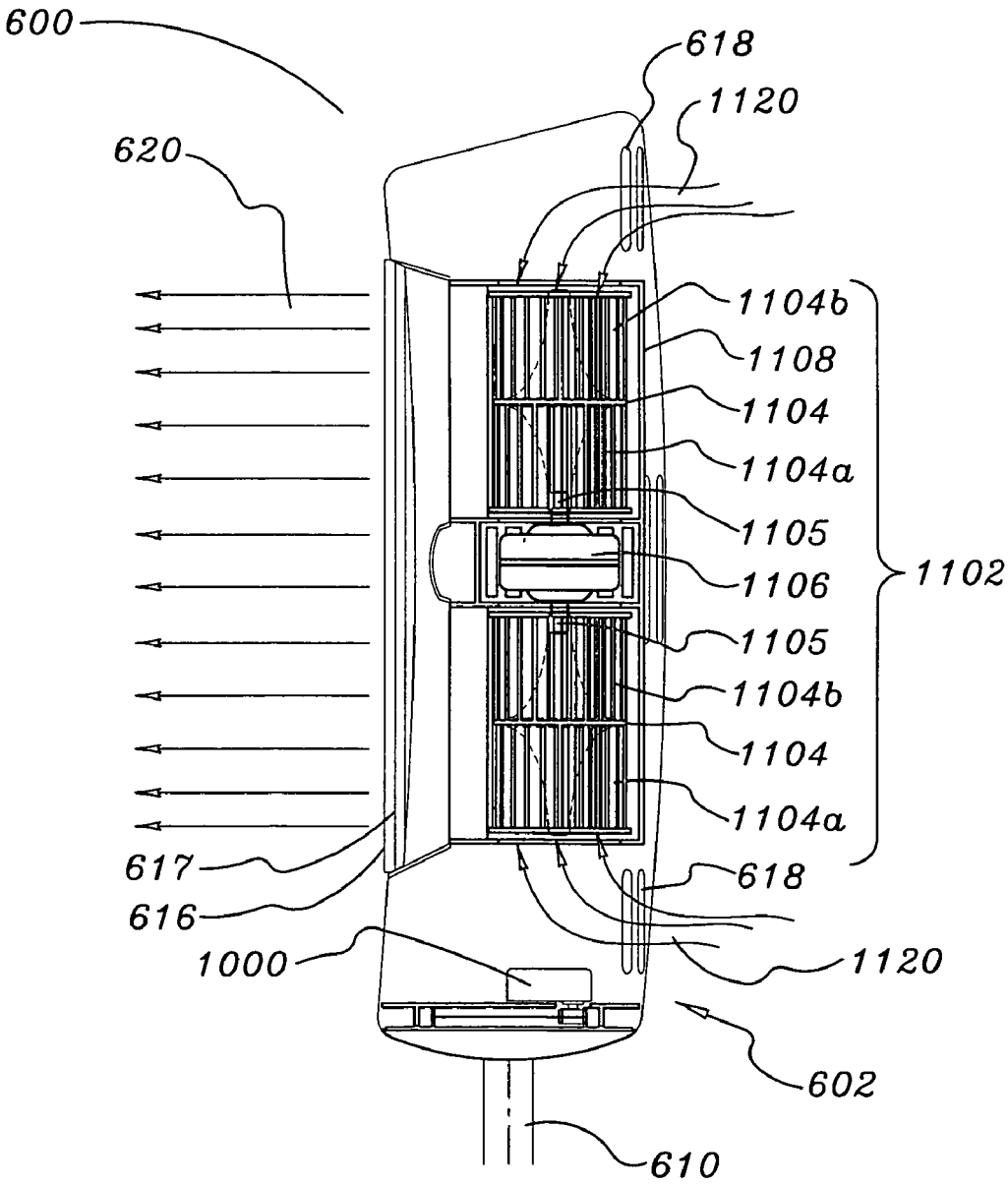

Positioned within the interior space defined by housing 602 and between inlet 618 and outlet 616 is air generator 1102, (best shown in FIG. 11A). Air generator 1102 receives air from inlet 618 and generates exhaust air 620 for output through outlet 616 such that output air 620 travels along a path substantially orthogonal to the longitudinal axis A of housing 602.

Home comfort appliance 600 may also include a controller, such as control assembly 603 mounted, for example, on an upper portion and/or front portion of housing 602 for controlling fan speed, rotation, oscillation, etc. Alternatively, control of home comfort appliance 600 may be accomplished by a remote control unit (not shown) in conjunction with or as a replacement for control assembly 603.

In one exemplary embodiment, housing 602 may be coupled directly to support column 610 such that housing 602 is fixed with respect to column 610. In another embodiment, an intermediate coupler 614 may be used to couple housing 602 to support column 610. Such a coupler 614 may be used with either the fixed or rotatable/moveable embodiments described above and below.

In one exemplary embodiment, housing 602 rotates with respect to support column 610. Such rotation may be accomplished either in an oscillatory fashion (over a range of up to about 360 degrees), a stepwise positioning of housing 602 (either manually of under automated control), or in a constant rotation, either in a clockwise or counter-clockwise direction. To accomplish automatic oscillation or rotation of housing 602, an oscillator or rotator, such as a motor and drive assembly 1000 (best shown in FIGS. 10A, 11A and 12A), may be used. Oscillator or rotator 1000 may be located within or below housing 602 and coupled between housing 602 and support column 610. In yet another embodiment the oscillator rotator 1000 may be located between base 612 and support column 610.

Figure 7A:
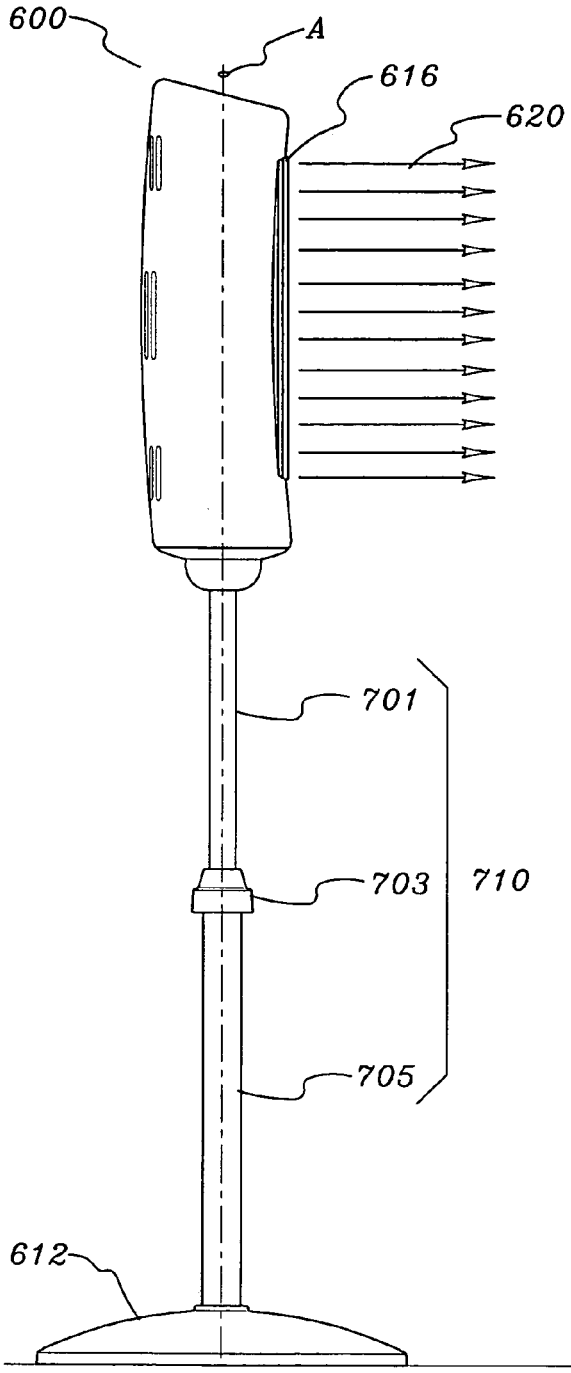
FIGS. 7A, 7B and 7C are views of another exemplary embodiment of the present invention with an adjustable support member.
Figure 7B:
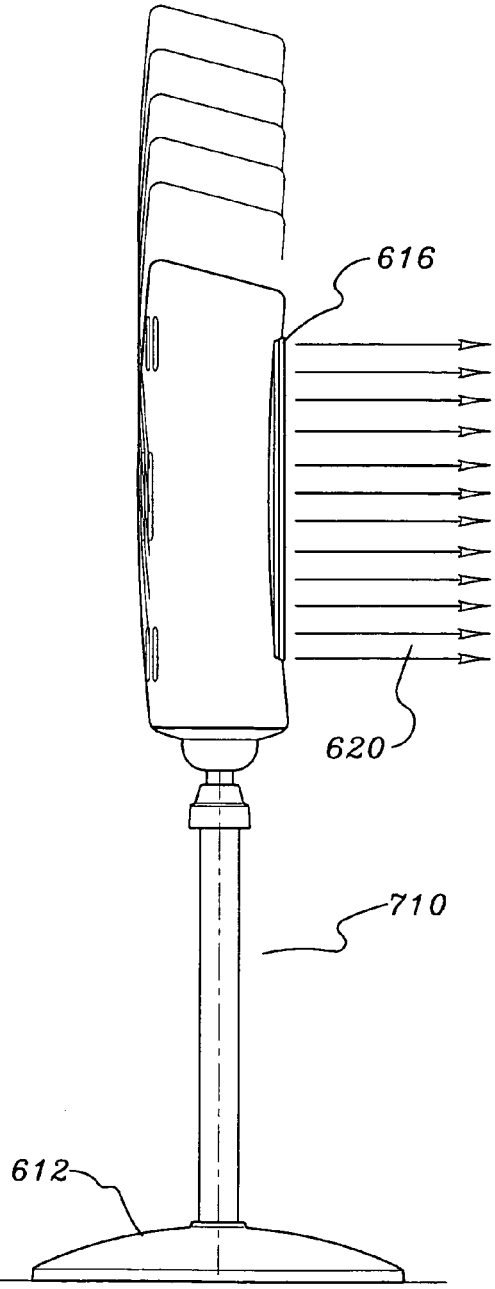
Figure 7C:
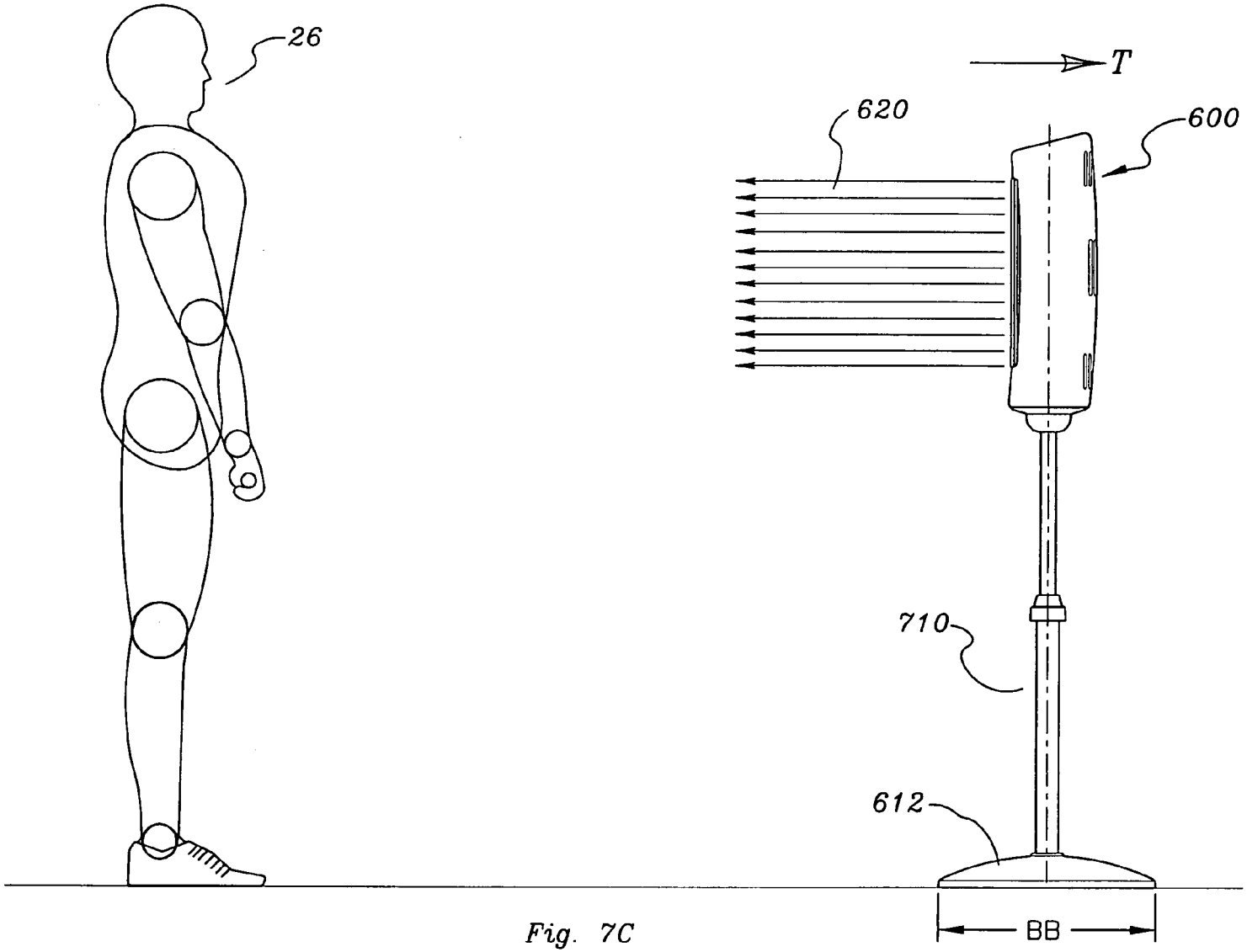

FIGS. 7A, 7B and 7C show an exemplary embodiment of an adjustable support column 710 having a plurality of cooperating columns. As shown, adjustable support column 710 is composed of an upper column 701, an adjustment coupler 703 and a lower column 705. In this example the overall height of home comfort appliance 600 can be changed to allow user 26 the maximum flexibility of elevation of exhaust air 620 above floor level.

Figure 8B:
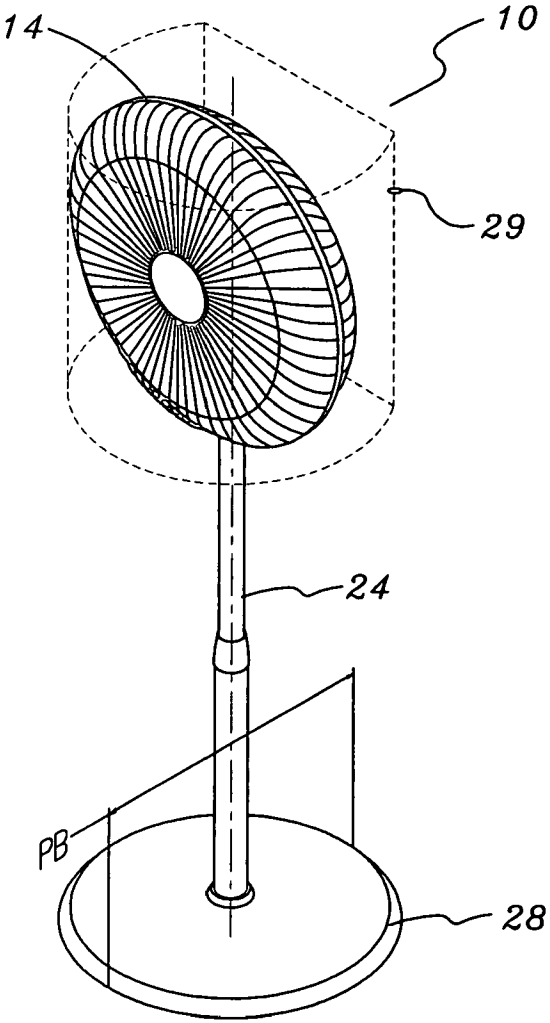
FIGS. 8A and 8B are comparative views of the present invention and a conventional pedestal fan.
Figure 8A:
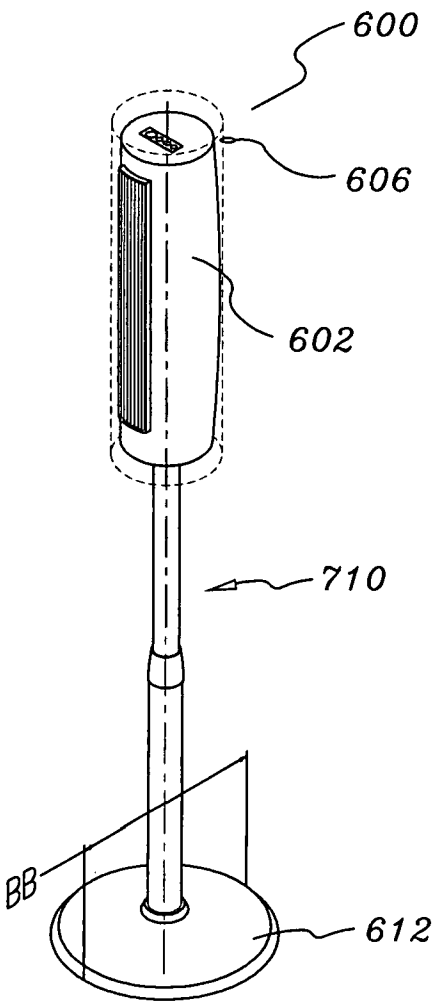

FIGS. 8A and 8B show comparison views of the home comfort device 600 and conventional pedestal fan 10. When compared, home comfort appliance 600 has a smaller area of oscillation 606 than the area of oscillation 29 of the conventional pedestal fan 10. This is due to the smaller size of housing 602 of home comfort appliance 600 when compared to the size of fan assembly 14 of conventional pedestal fan 10. The area of oscillation 606 is defined as the area of movement about an axis of rotation of housing 602 of home comfort device 600. The area of oscillation 29 is defined as the area of movement about an axis of rotation of fan assembly 14 of conventional pedestal fan 10.

The axis of rotation of the blade of fan assembly 14 is oriented horizontally on conventional pedestal fan 10. In contrast, the axis of rotation of the air impeller in air generator 1102 (best shown in FIG. 11A) of home comfort device 600 is oriented vertically. This difference reduces the effects of gyroscopic precession during the oscillation of housing 602 and increases the stability of home comfort device 600 when compared to the effects of gyroscopic precession during oscillation of fan assembly 14 of conventional pedestal fan 10.

The structure of housing 602, which allows a smaller area of oscillation 606, centers the oscillated components of home comfort device 600 substantially on the center of support column 710. This structure, along with the reduced effects of gyroscopic precession during oscillation and the lower thrust characteristics of the home comfort device 600, (best shown in FIGS. 15A and 15B) allow base 612 of home comfort appliance 600 to have a maximum width dimension BB that is smaller when compared to the maximum width dimension PB of base 28 of conventional pedestal fan 10. The smaller maximum width dimension BB of base 612, allows home comfort device 600 to have space saving characteristics when compared to conventional pedestal fan 10. Also as shown, due to its size, home comfort device 600 may be easily transported from place to place within a living space or between various living spaces as desired.

In one exemplary embodiment the maximum width, taken along a horizontal plane of the area of oscillation 606, is less than about 70% of the maximum width dimension BB of home comfort device 600. In another exemplary embodiment, maximum width dimension BB of base 612 is less than about 17 inches.

In another exemplary embodiment the maximum width, taken along a horizontal plane of the area of oscillation 606 of home comfort device 600 is about 85% of the maximum width, taken along a horizontal plane of the area of oscillation 29 of conventional pedestal fan 10.

Figure 4A:
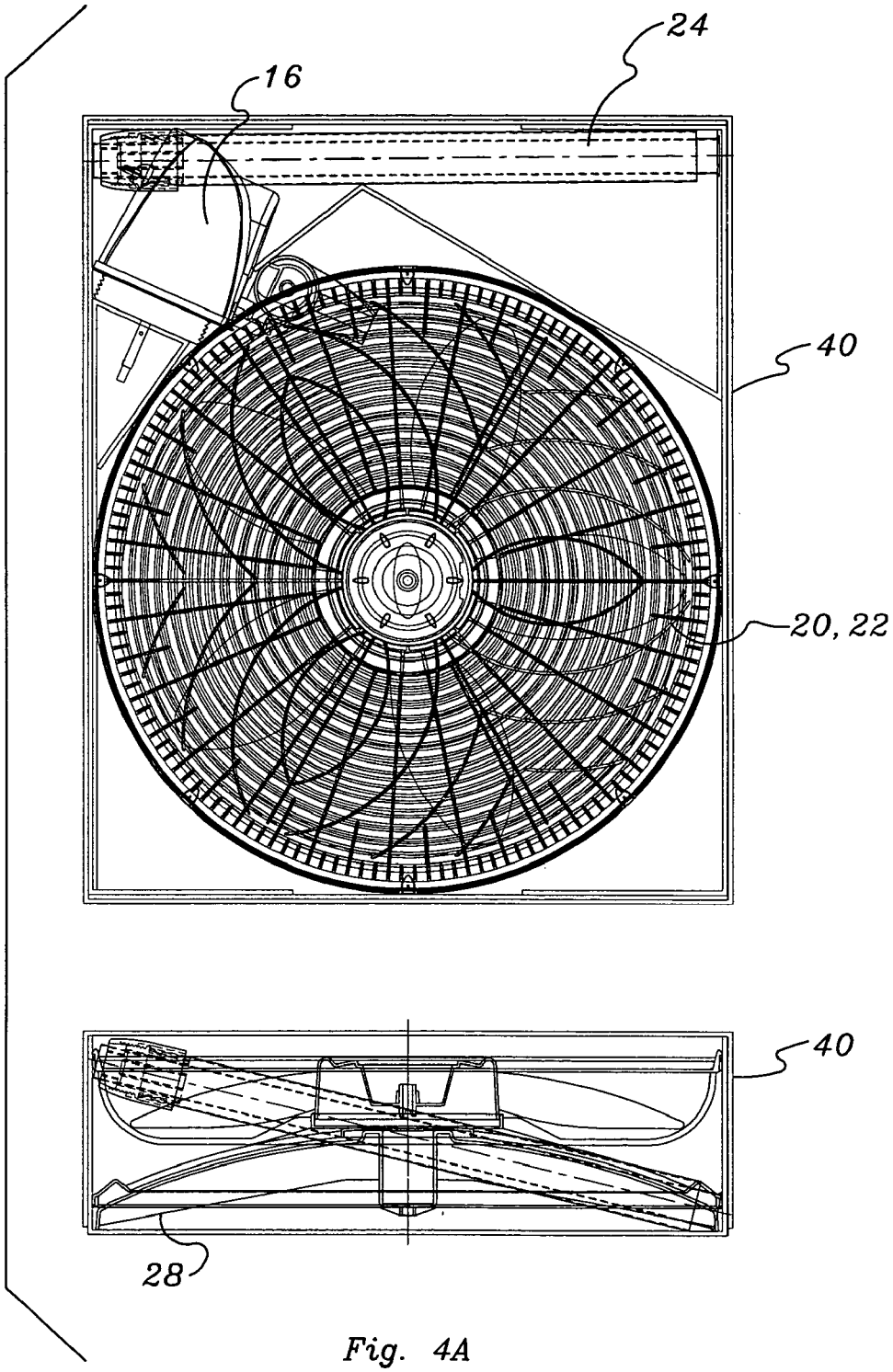
Fig. 4A PRIOR ART
FIGS. 4A, 4B and 4C are views of packaging for a conventional pedestal fan of FIG. 1.
Figure 4B:
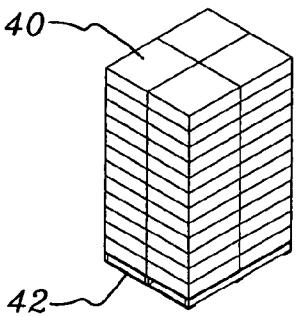
Figure 5A:
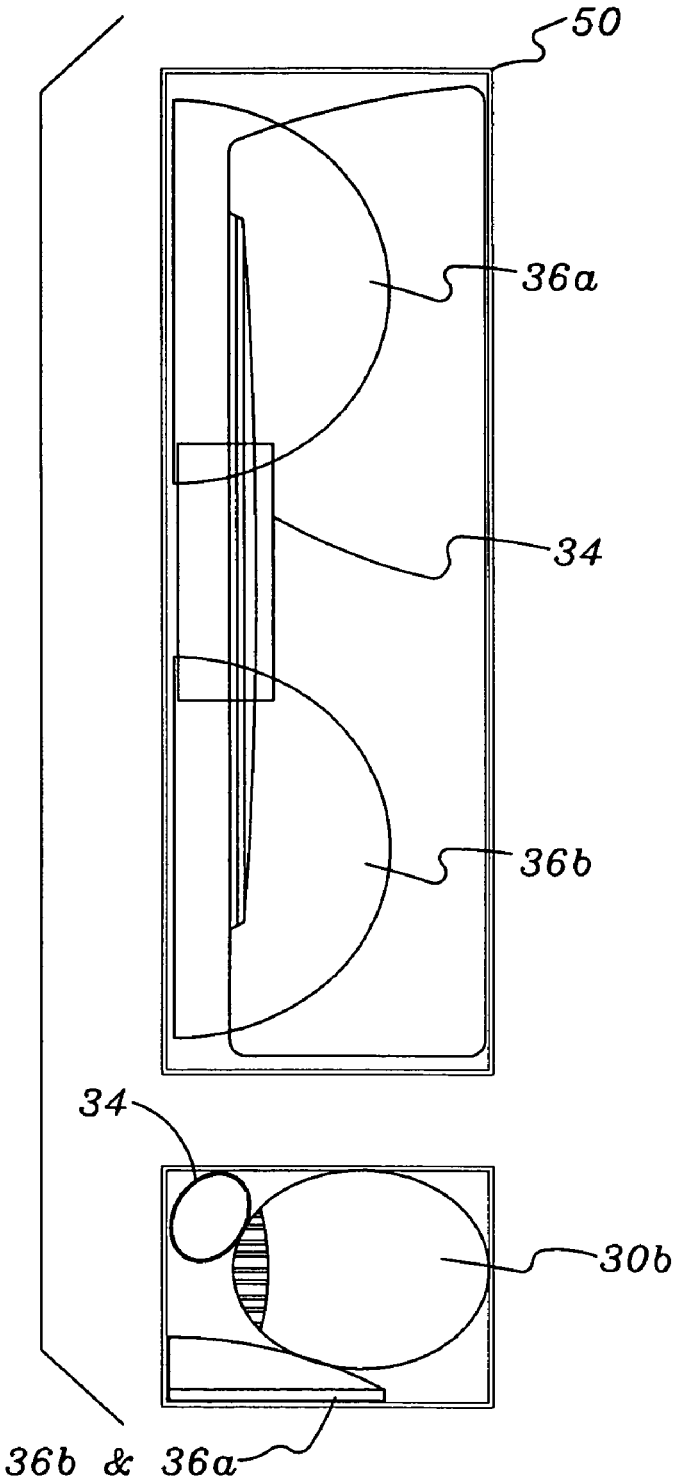
Fig. 5A PRIOR ART
FIGS. 5A, 5B and 5C are views of packaging for a conventional tower type fans of FIGS. 3A and 3B.
Figure 9A:
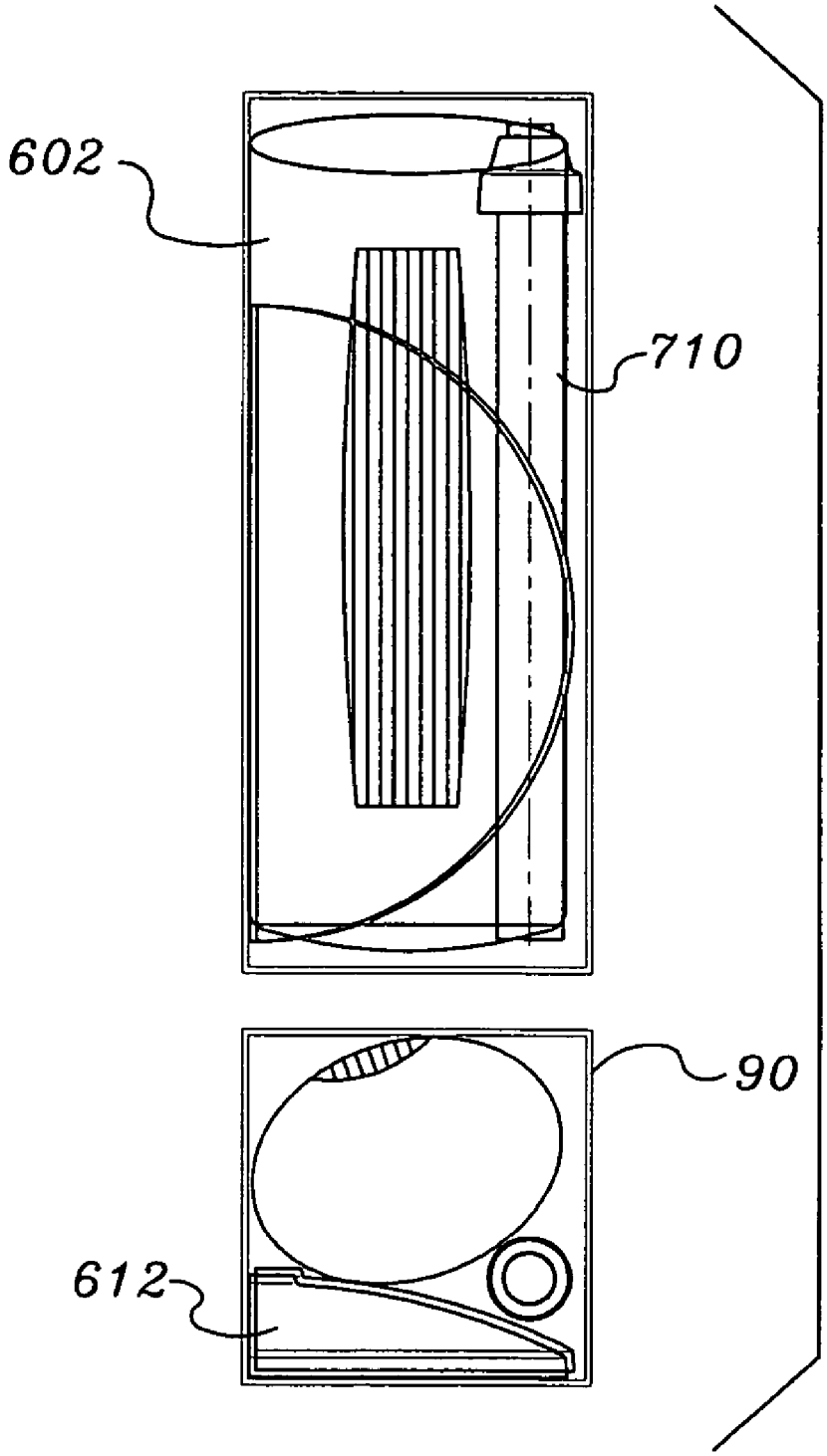
FIGS. 9A, 9B and 9C are views of packaging for the present invention.
Figures 9B, 9C:
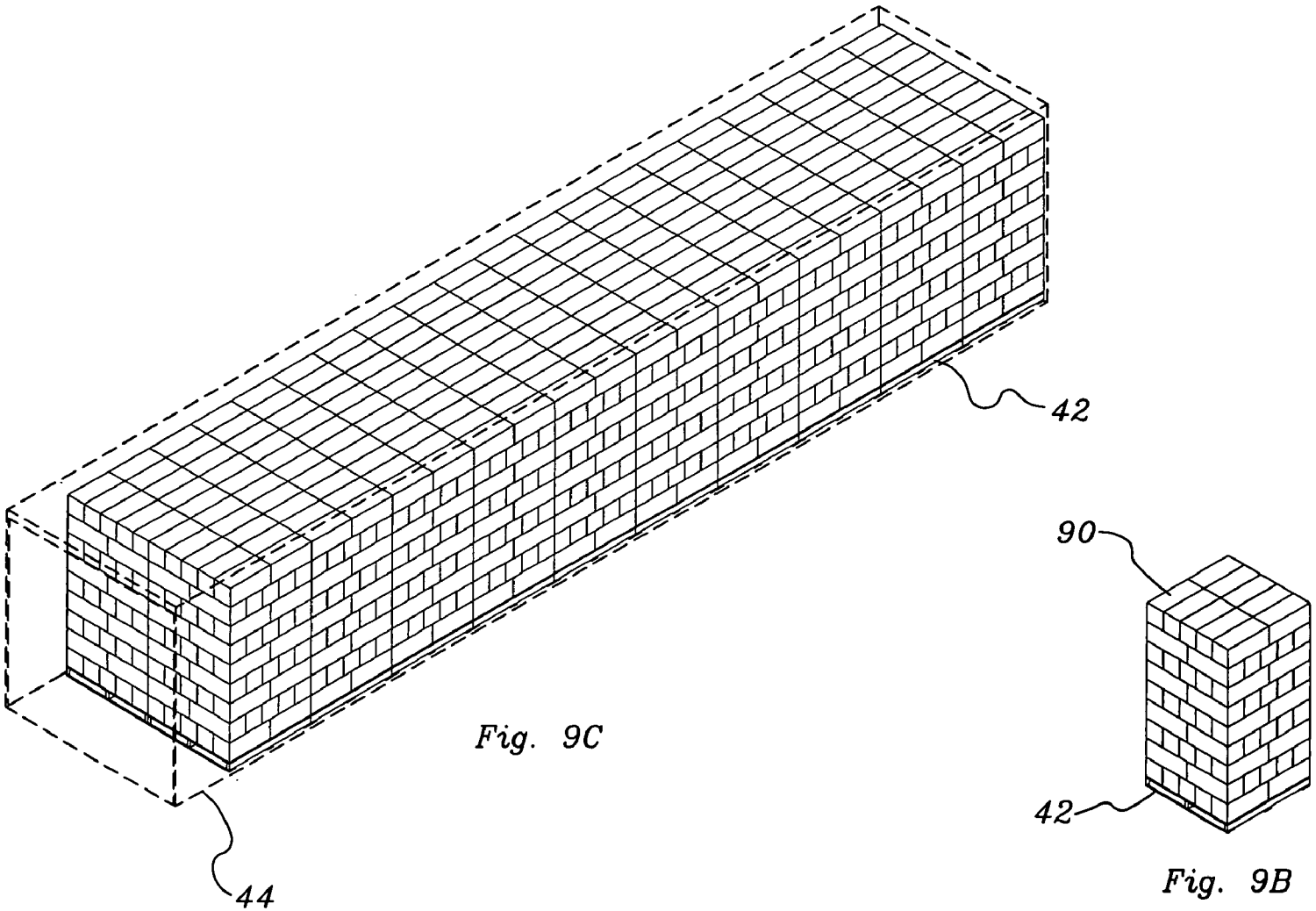

FIGS. 9A, 9B and 9C illustrate another advantage realized with respect to packaging and shipment of the exemplary design of the home comfort device of the present invention. As shown in FIG. 9A, the home comfort device is packaged in shipping box 90. Shipping box 90 is smaller than shipping box 40 (see FIG. 4A) of the conventional pedestal fan, or shipping box 50 (see FIG. 5A) of the conventional tower fan, thus using less packaging materials and lowering the cost of the packaging.

In one exemplary embodiment, shipping box 90 of the home comfort device is less than about 80% of shipping box 40 of the conventional pedestal fan or shipping box 50 of the conventional tower fan. In yet another exemplary embodiment, shipping box 90 has a length of less than about 23 inches, a width of less than about 9 inches and a height of less than about 9 inches.

Figure 4C:
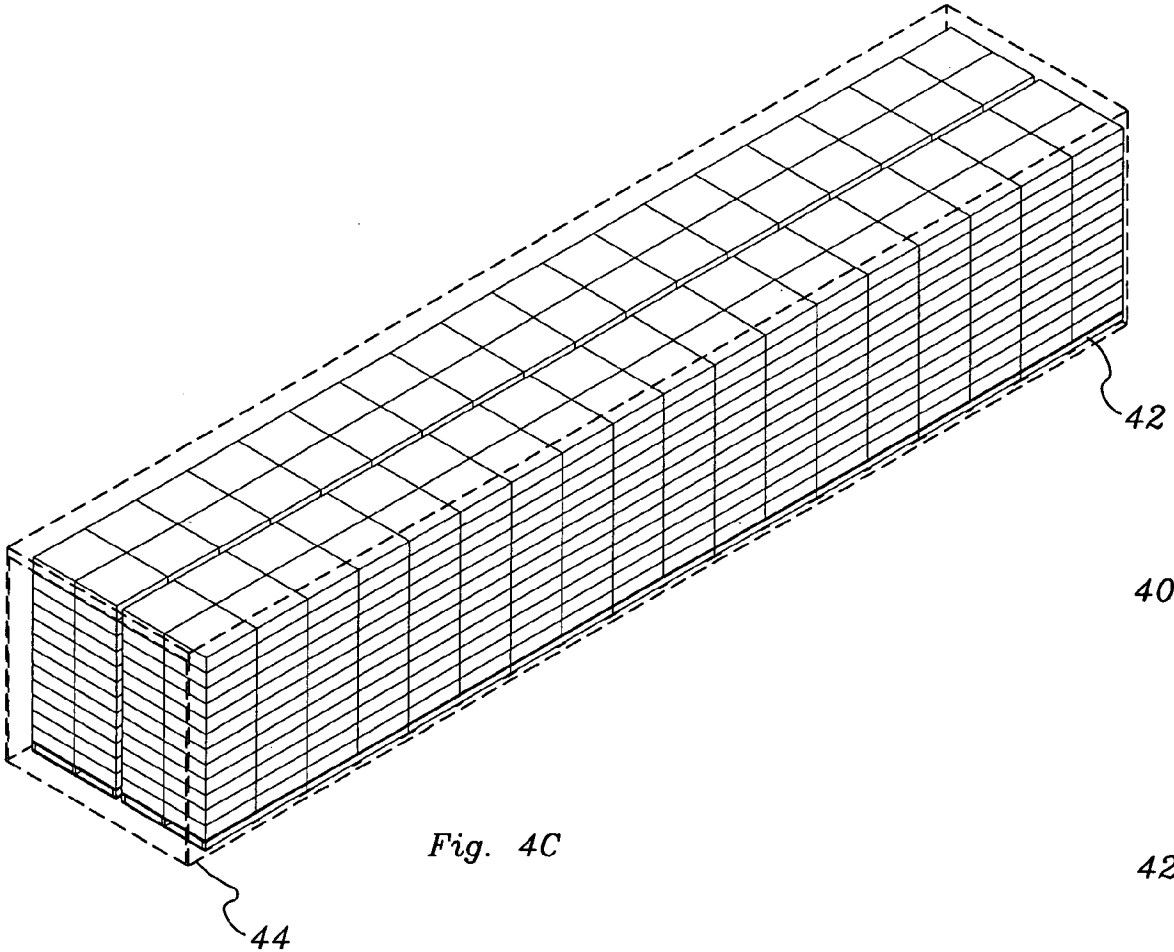
Fig. 4C PRIOR ART
Figures 5B, 5C:
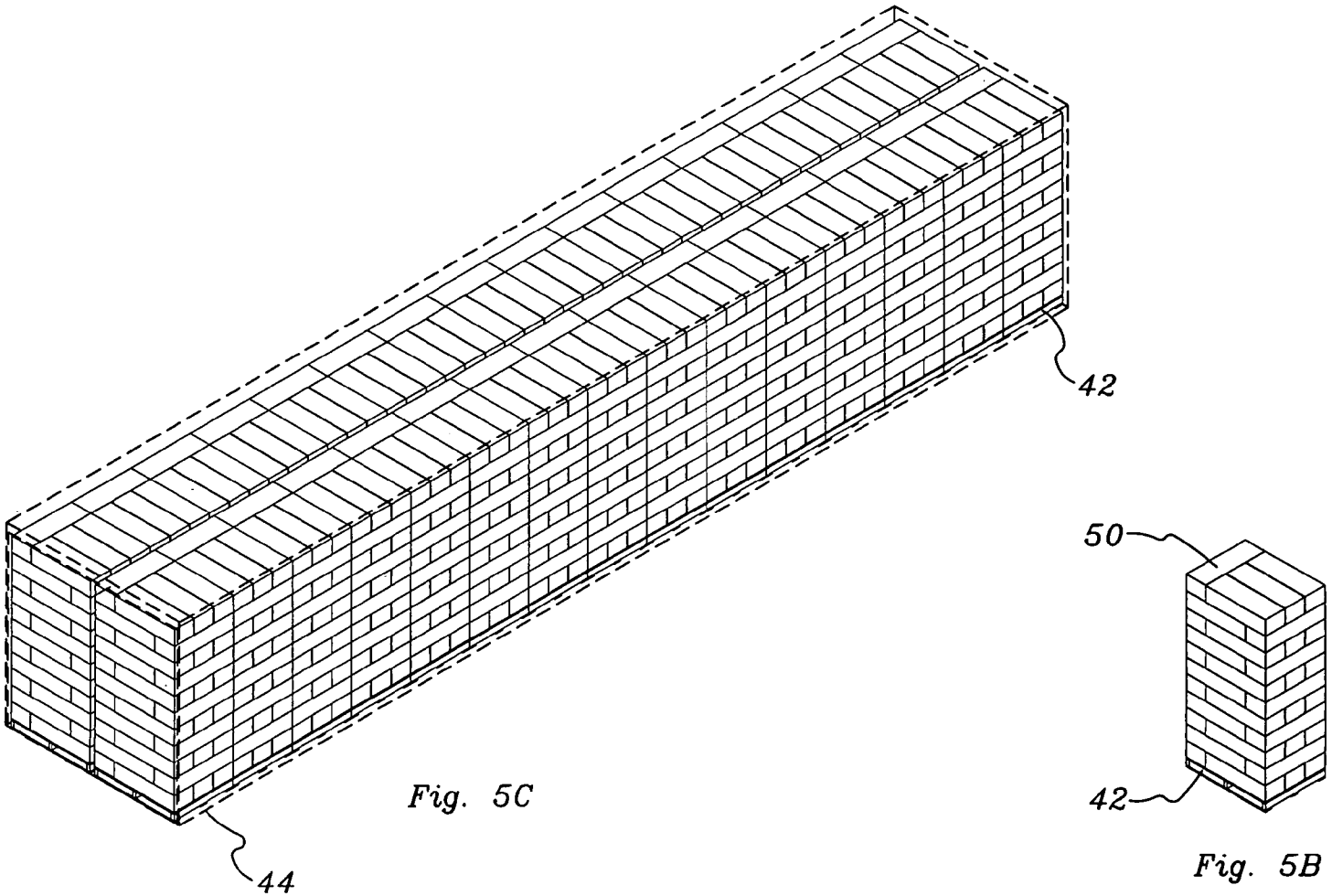
Fig. 5C PRIOR ART

As shown in FIG. 9C, when compared to conventional pedestal fan and conventional tower fan, packaging of the home comfort device of the present invention in container 44 requires much less packaging volume. Furthermore, the number of units capable of transportation in shipping container 44 as shown in FIG. 9C increases by over 20%, as compared to FIG. 4C and FIG. 5C. These shipping advantages yield a lower cost of transportation and a cost advantage for the manufacturer and the consumer.

Figure 10B:
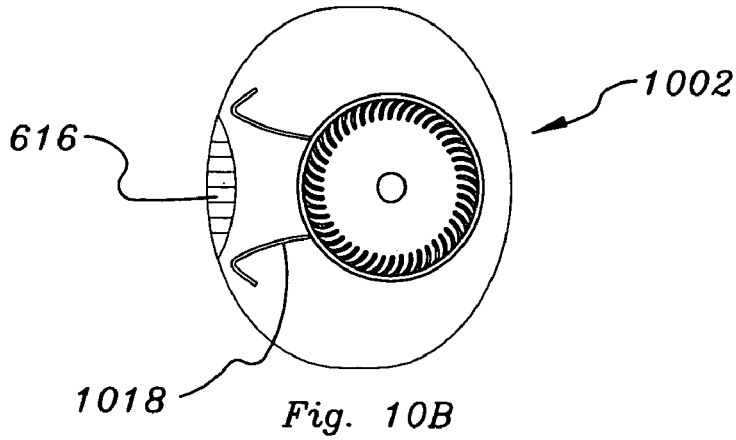
FIGS. 10A and 10B are various cross-sectional views of an exemplary embodiment of the present invention.
Figure 10A:
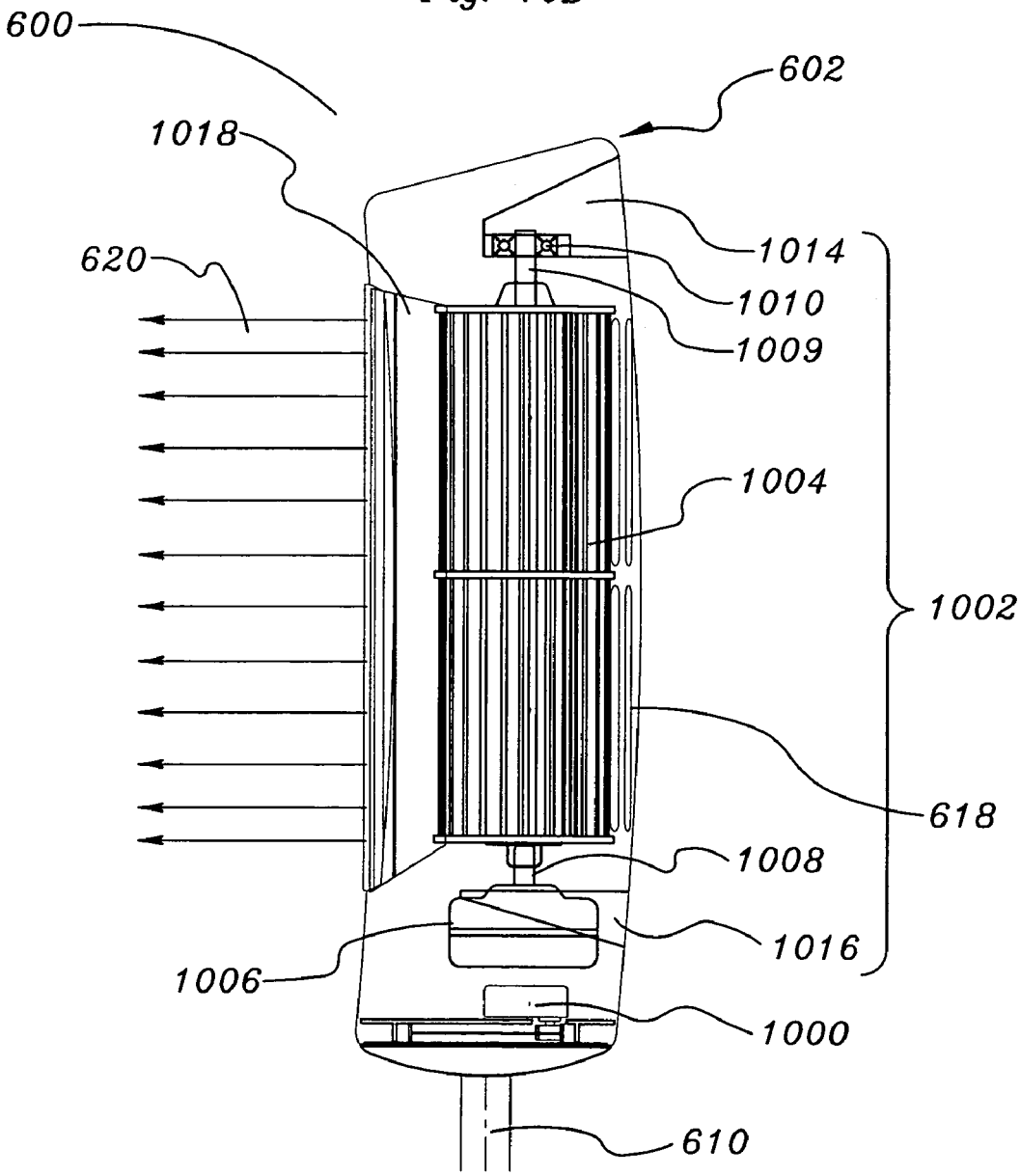

FIGS. 10A and 10B show an exemplary embodiment where a transverse air generator 1002 is positioned within housing 602. Air generator 1002 receives a supply of air through at least one inlet port 618 in housing 602. Air generator 1002 comprises motor 1006 having shaft 1008 coupled to at least one of the upper end or lower end of blade assembly 1004. Motor 1006 is supported by lower support member 1016, for example, which is in turn attached to housing 602. An upper shaft 1009 terminates at remote bearing 1010 with is in turn attached to housing 602 by upper support bracket 1014. Upper shaft 1009 may be an extension of shaft 1008 or may be a separate shaft coupled to an upper portion of blade assembly 1004, for example.

Figure 14B:
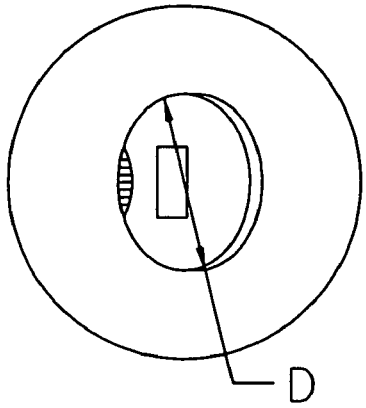
FIGS. 14A and 14B are various views of an exemplary embodiment of the present invention illustrating various dimensional relationships of the cooperating elements.
Figure 14A:
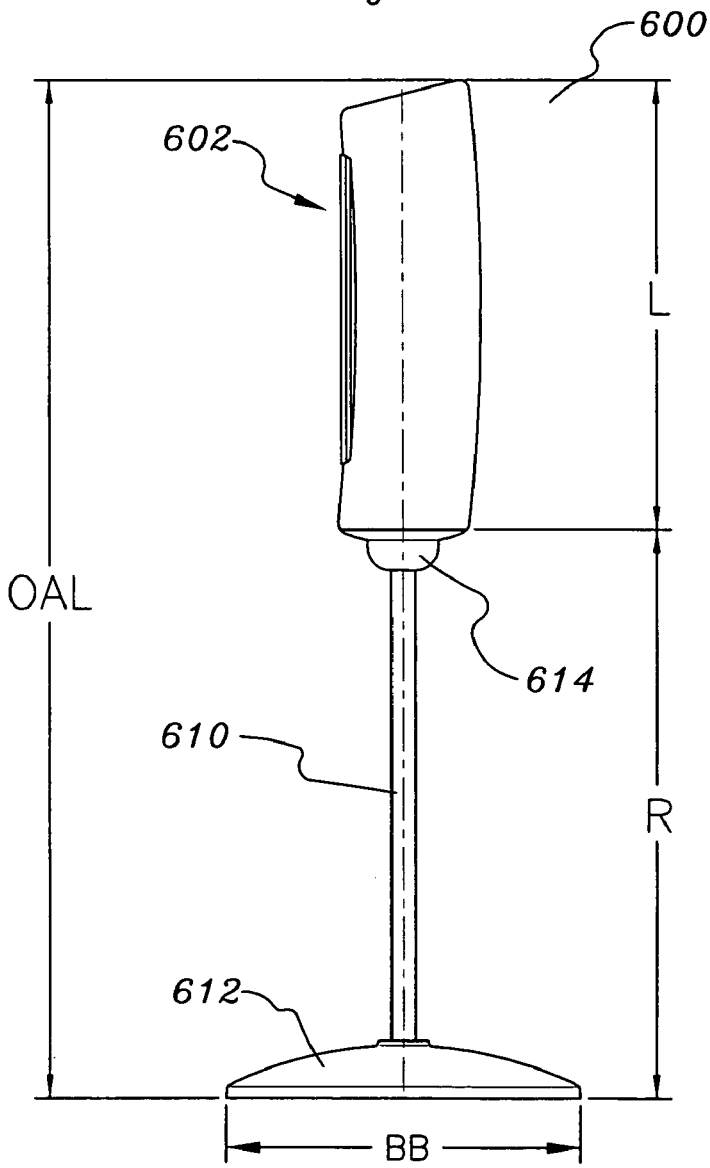

In one exemplary embodiment, blade assembly 1004 has an overall length no greater than 45% of an overall length OAL of home comfort appliance 600 (best seen in FIG. 14A). This has the advantage of minimizing, if not eliminating, manufacturing problems associated with conventional designs in that, by having a short blade assembly 1004 with respect to overall length OAL, alignment problems between adjacent portions of the blade assembly are avoided. Further, alignment of the blade assembly with the motor shaft is more precise resulting in a reduction in impeller noise due to blade imbalance between the motor and blade and/or between portions of the assembled blade. Additionally, the exemplary design allows for the use of a lower power motor due at least in part to the reduction of the length of blade assembly 1004, thereby reducing mass and rotational resistance.

The output of air generator 1002 is coupled to air guide 1018 which acts to direct exhaust air from air generator 1002 to outlet 616. In one exemplary embodiment, air guide 1018 also acts as a cut-off to prevent air from entering air generator 1002 other than through inlet port 618. Here too the length of exemplary blade assembly 1004 provides an advantage over prior art designs, in that alignment of blade assembly 1004 with air guide 1018 is more precise; thus, maximizing the velocity of exhaust air 620 generated by home comfort appliance 600.

In another embodiment air generator 1002 is a pre-assembled unit that may include oscillation and may include controls. Utilizing air generator 1002 as a pre-assembled component simplifies assembly when compared to assembling motor 1006, blade assembly 1004, upper shaft 1009, bearing 1010, air guide 1018, oscillator or rotator 1000 and controls (not shown) into the device as separate components.

In one exemplary embodiment, exhaust air 620 flows along a path that is substantially perpendicular to the longitudinal axis of housing 602.

FIGS. 11A–11B show another exemplary embodiment where air generation unit 1102 is a unitary centrifugal blower assembly. Air generator 1102 includes a motor 1106 disposed between impellers 1104, each of which are coupled to motor 1106 at shafts 1105 extending from opposite sides of motor 1106, all of which is disposed within housing 1108. In this example, air impeller 1104 is a centrifugal blower type impeller.

In one embodiment of the invention, impeller 1104 comprises at least one, but no more than two sections 1104*a*, 1104*b* formed as a unitary part. By forming impeller 1104 as a unitary part, greater tolerances may be achieved, thus minimizing vibration and attendant operational noise in air generator 1102 as well as maximizing output from air generator 1102 by minimizing the entry of air into the exhaust section of the air generator.

In another embodiment, air generator 1102 is a pre-assembled unit that may include oscillation and may include controls. Utilizing air generator 1102 as a pre-assembled component simplifies assembly when compared to assembling housing 1108, motor 1106 and impellers 1104*a*, 1104*b*, oscillator or rotator 1000 and controls (not shown) into the device as separate components.

As shown in FIG. 11A, inlet air 1120 enters through inlet 618 in housing 602 and enters an end portion of air generation assembly 1102. Exhaust air 620 traveling in a path substantially orthogonal to inlet air 1120 entering the air generator 1102 is channeled to outlet 616 by concentrator 1110 which is disposed between the outlet of air generator assembly 1102 and outlet 616. Alternatively, inlet air 1120 can enter through inlet 618 in housing 602 and in turn enters a rear portion of air generator assembly 1102.

Outlet 616 comprises grill 617 coupled to housing 602. In one exemplary embodiment grill 617 comprises substantially parallel louvers. The louvers may be stationary or moveable in either or both vertical and horizontal directions, as desired.

Figure 12B:
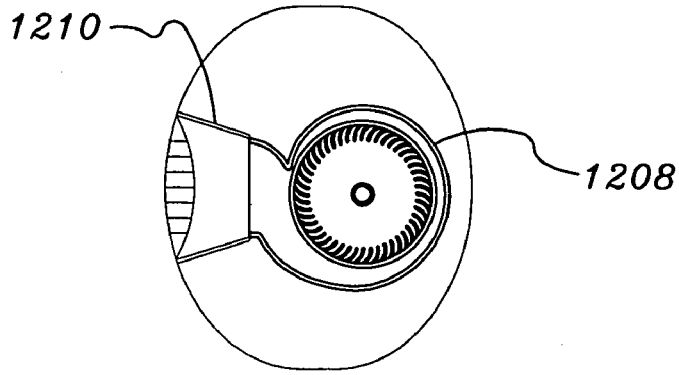
FIGS. 12A and 12B are various cross-sectional views of yet another exemplary embodiment of the present invention.
Figure 12A:
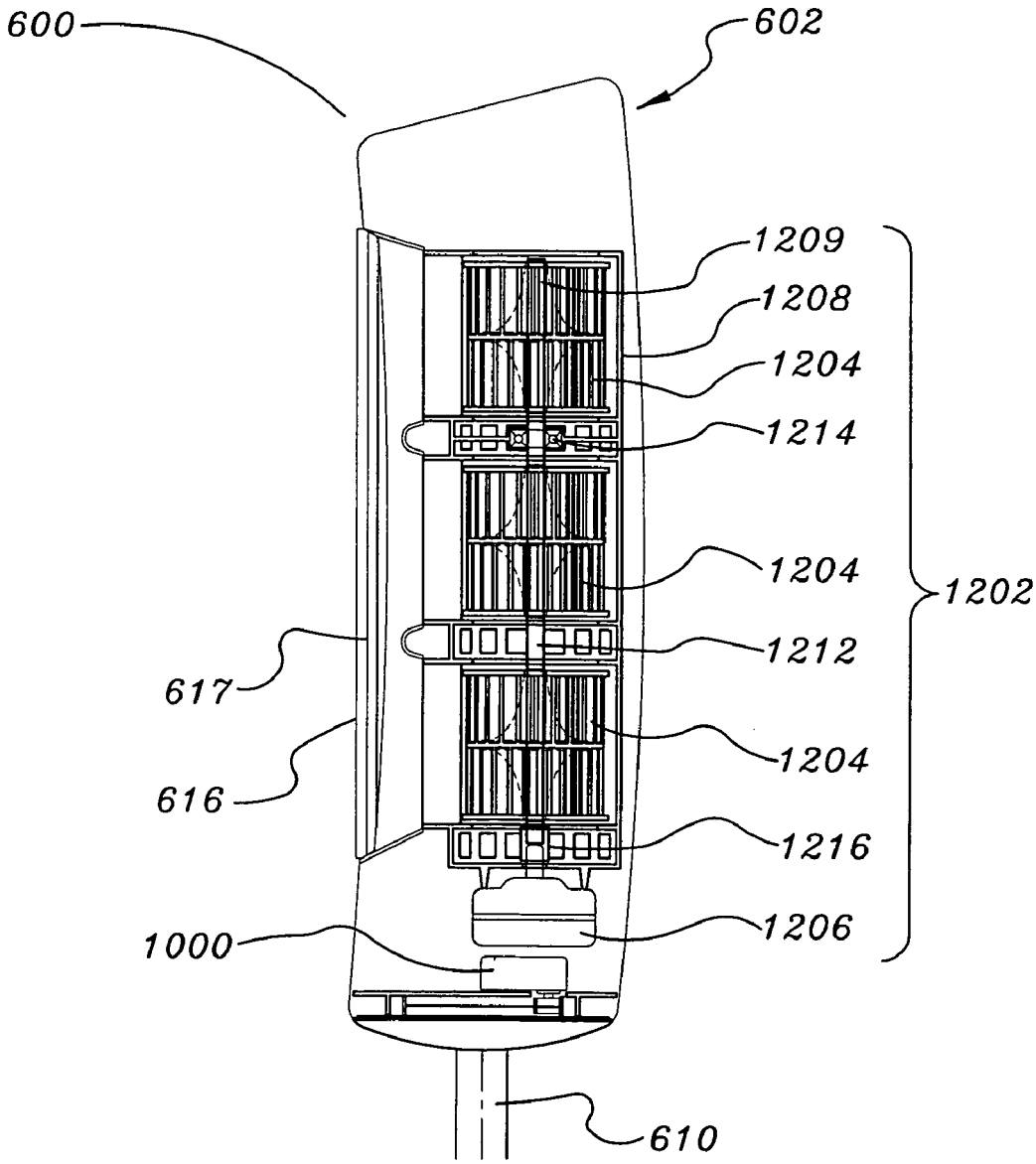
Figure 13B:
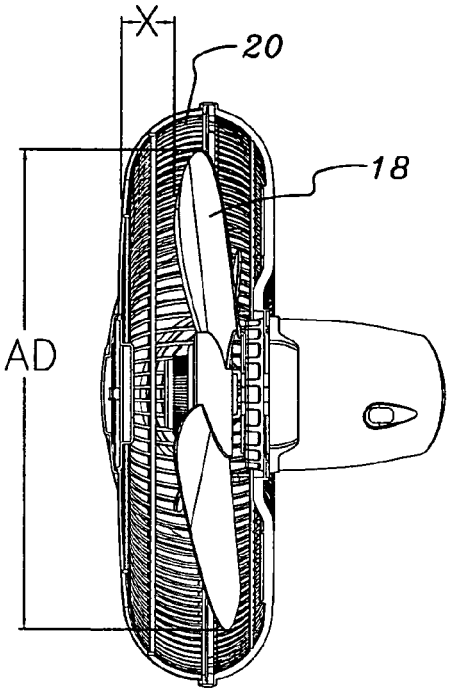
FIGS. 13A, 13B, 13C and 13D are various cross-sectional views comparing a conventional pedestal fan to an exemplary embodiment of the present invention.
Figure 13D:
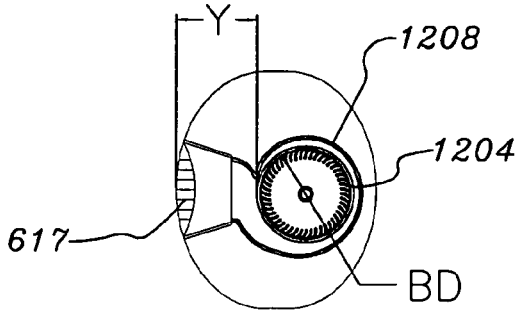
Figure 13A:
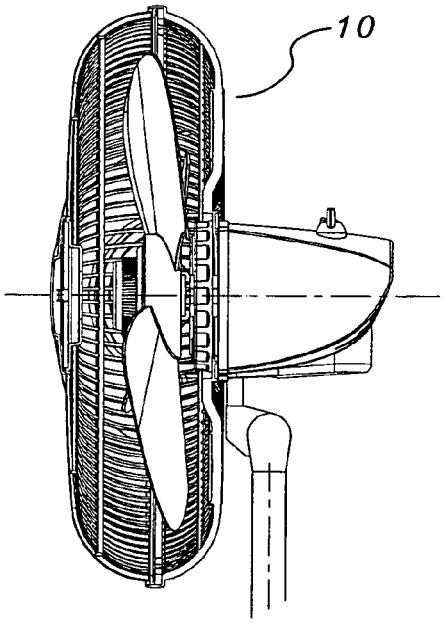
Figure 13C:
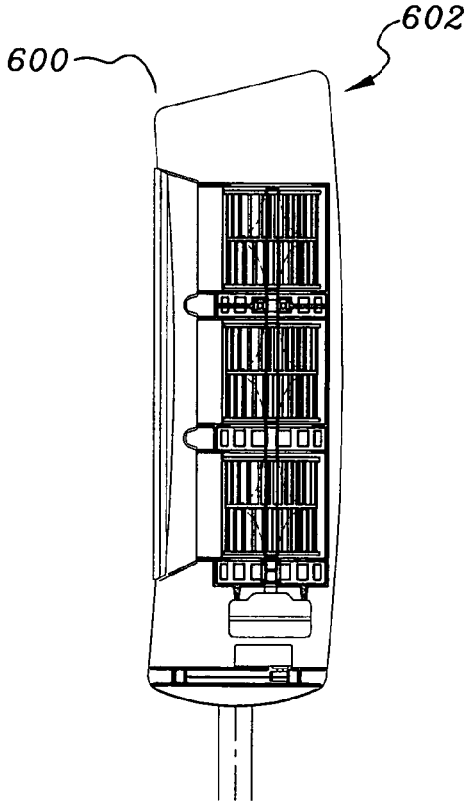

FIGS. 12A and 12B show yet another exemplary embodiment where unit air generator 1202 is a unitary centrifugal blower assembly. Air generator 1202 includes a motor 1206 having shaft 1209 coupled to blade assemblies (impellers) 1204. An upper portion of shaft 1209 is coupled at remote bearing 1214 which is disposed between adjacent blade assemblies 1204. In one embodiment, impellers 1204 are comprised of at least one, but no more than two sections formed as a unitary part. Each impeller 1204 is coupled to shaft 1209 at one or more of an upper portion, central portion, and/or lower portion of impeller 1204.

In another embodiment, air generator 1202 is a pre-assembled unit that may include oscillation and may include controls. Utilizing air generator 1202 as a pre-assembled component simplifies assembly when compared to assembling housing 1208, motor 1206 and impellers 1204, shaft 1209, remote bearing 1214, oscillator or rotator 1000 and controls (not shown) into the device as separate components.

FIGS. 13A, 13B, 13C, and 13D illustrate a comparison of a conventional pedestal fan to an exemplary embodiment of the present invention. In conventional fan 10, (shown in FIGS. 13A and 13B) set back distance X between axial blade 18 and front grill 20 is between about 5% to about 15% of axial blade 18 diameter AD. In contrast, in the embodiment of the home comfort device 600 of the present invention (shown in FIGS. 13C and 13D), set back distance Y between the leading edge of impeller 1204 and front of grill 717 is at least about 20% of diameter BD of impeller 1204. Thus, in the exemplary embodiment of home comfort device 600, impeller 1204 is more concealed than axial fan blade 18 in the conventional pedestal fan 10, thereby providing an additional advantage in that it is more difficult for foreign objects to penetrate the grill 617 and reach the impeller 1204 of the air generator.

FIGS. 14A and 14B show various dimensional relationships of the home comfort device of the present invention. As shown, length L is the length of housing 602 and dimension D is the maximum cross-sectional width of a cross section taken through housing 602 on a horizontal plane. The combination of base 612 and support column 610 defines a rise height R.

As shown, dimension D of housing 602 is less than about 90% of length L of housing 602. In one exemplary embodiment length L of housing 602 is at least about 1.5 times greater than dimension D of housing 602.

Rise height R is at least about 40% of length L of housing 602, and preferably between about 40% to about 400% of length L of housing 602. In addition, rise height R is greater than about 29% of overall length OAL of home comfort appliance 600 and preferably between about 29% and about 80% of overall length OAL. Length L of housing 602 is less than about 68% of overall length OAL and preferably between about 20% and about 68% of overall length OAL.

In one exemplary embodiment, rise height R is at least about 12 inches and may be adjustable as desired. Further, length L of housing 602 may be between about 15 and about 30 inches while the overall length OAL from the floor to the top of home comfort appliance 600 may be at least about 45 inches, and alternatively between about 45 to about 60 inches In another exemplary embodiment, the maximum width of a cross section taken through housing 602 on a horizontal plane, dimension D is less than about 12 inches.

Figure 15A:
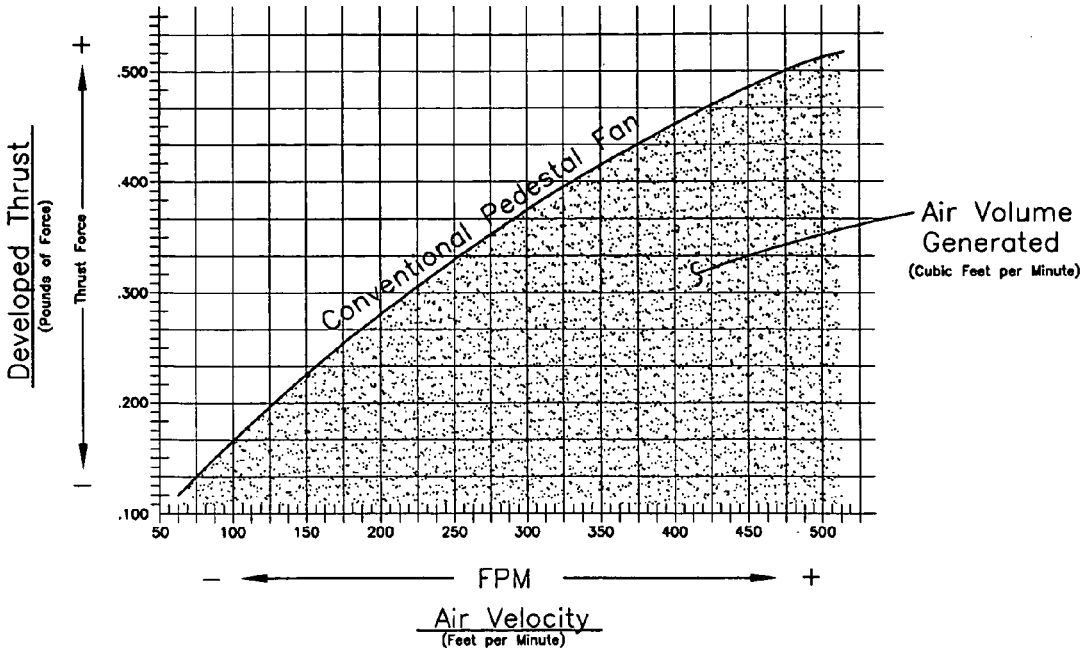
FIGS. 15A and 15B illustrate two graphs that compare the thrust characteristic differences of a conventional pedestal fan and the present invention.
Figure 15B:
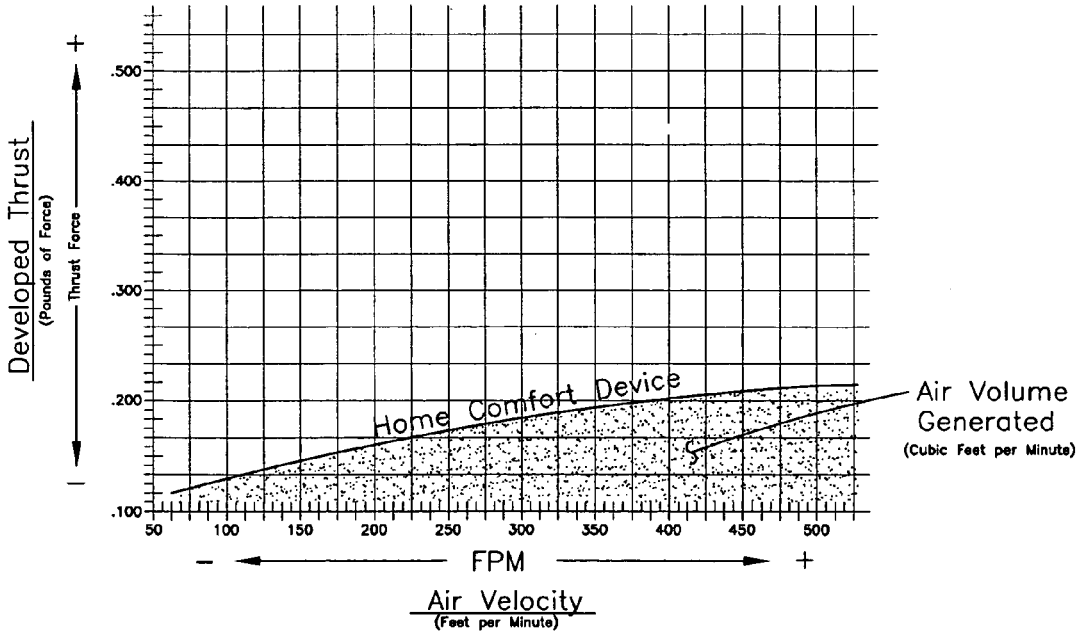

FIGS. 15A and 15B compare the thrust characteristics of a conventional pedestal fan and the home comfort appliance 600 of the present invention. The air generator 1102 of the present invention (home comfort device 600) has been so designed to assure a high air velocity while minimizing thrust. Maintaining the velocity at a high level maximizes the cooling effect for the end user. Minimizing thrust allows the base 612 of home comfort device 600 to be made smaller when compared to base 28 of conventional pedestal fan 10. This allows advantages for space savings in both the functional assembly of the home comfort device and the packaging of the home comfort device.

In one exemplary embodiment, the air velocity generated is at least about 400 feet per minute and preferably between about 400 feet per minute and about 600 feet per minute when measured 6 feet from the home comfort device of the present invention, and the thrust generated is between about 0.1 lbs and about 0.3 lbs.

Figure 16B:
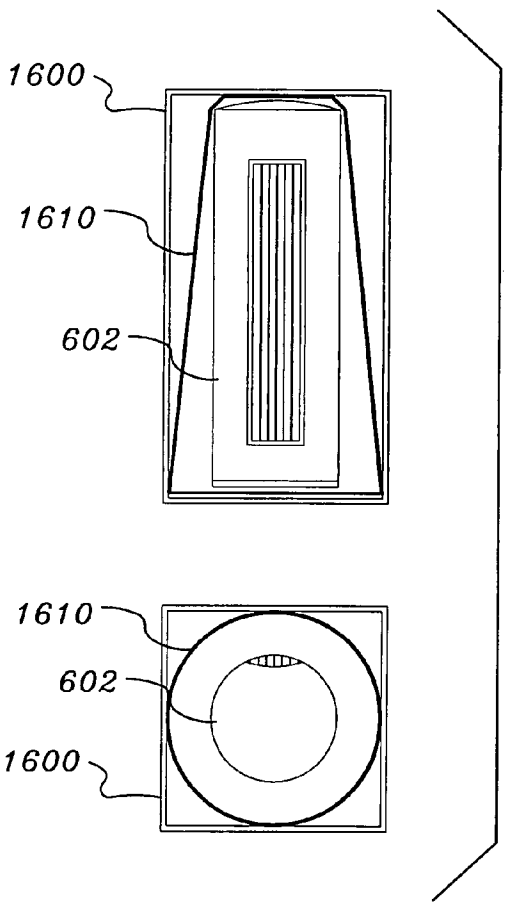
FIGS. 16A and 16B are views of yet another exemplary embodiment of the present invention with packaging.
Figure 16A:
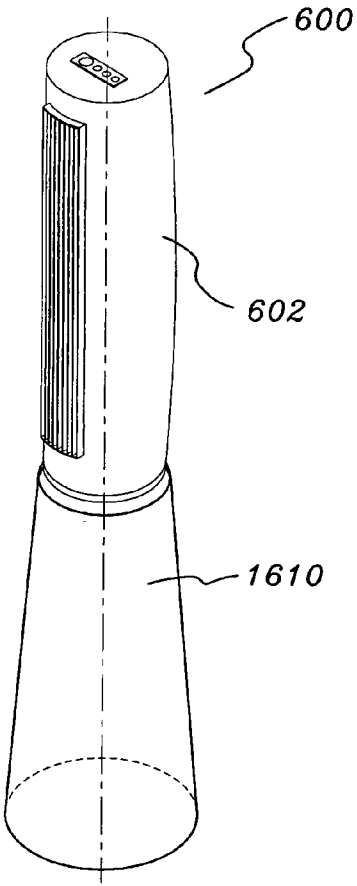

FIGS. 16A and 16B show another exemplary embodiment of home comfort device 600 with support 1610. Support 1610 can be a unitary part or constructed of more than one piece assembled together. Support 1610 achieves the designed rise height, (RH) and stability that support column 610 and base 612 achieved in previously described embodiments. FIG. 16B illustrates the packaging of home comfort device 600 in a non-operating configuration, wherein housing 602 is separated from support 1610. In this example housing 602 has the ability to fit within support 1610. Shipping box 1600 is therefore able to economize the space necessary to transport home comfort device 600, thus using less packaging materials and lowering the cost of the packaging.

Figure 17A:
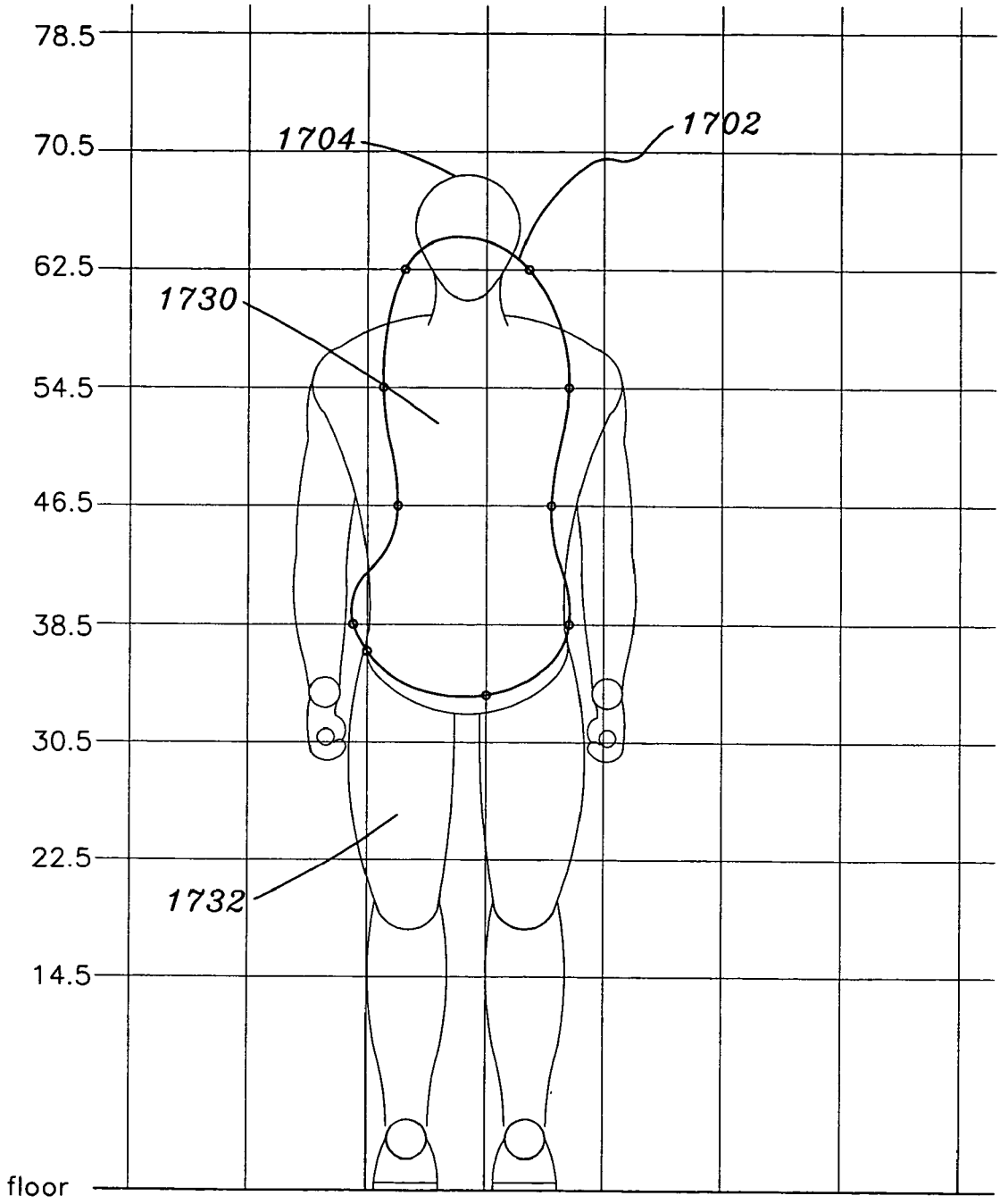
FIG. 17A illustrated an exhaust air pattern of an exemplary embodiment of the present invention.
Figure 17B:
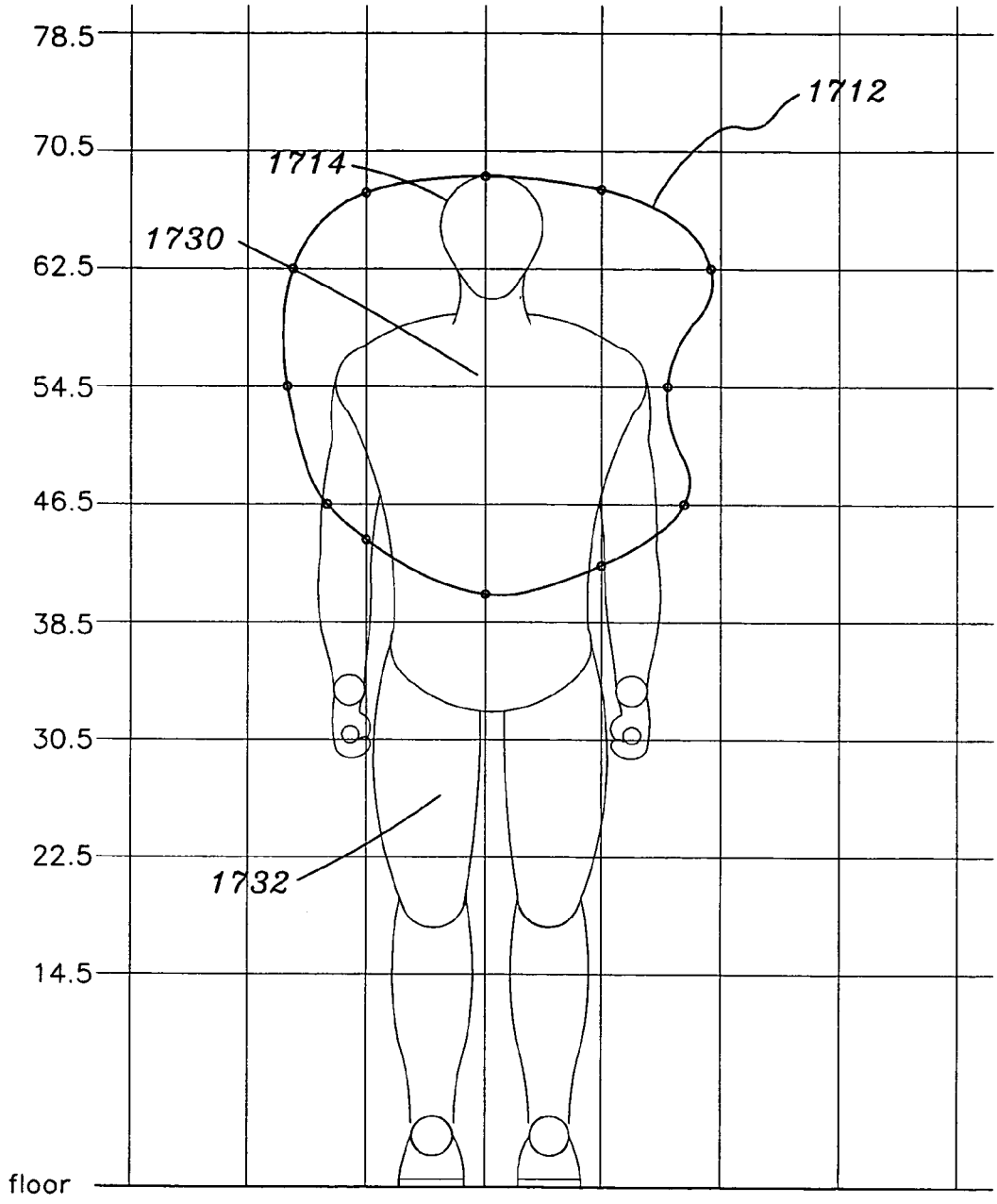
Fig. 17B PRIOR ART
FIGS. 17B and 17C illustrate air exhaust patterns of a conventional pedestal and a conventional tower fan, respectively.
Figure 17C:
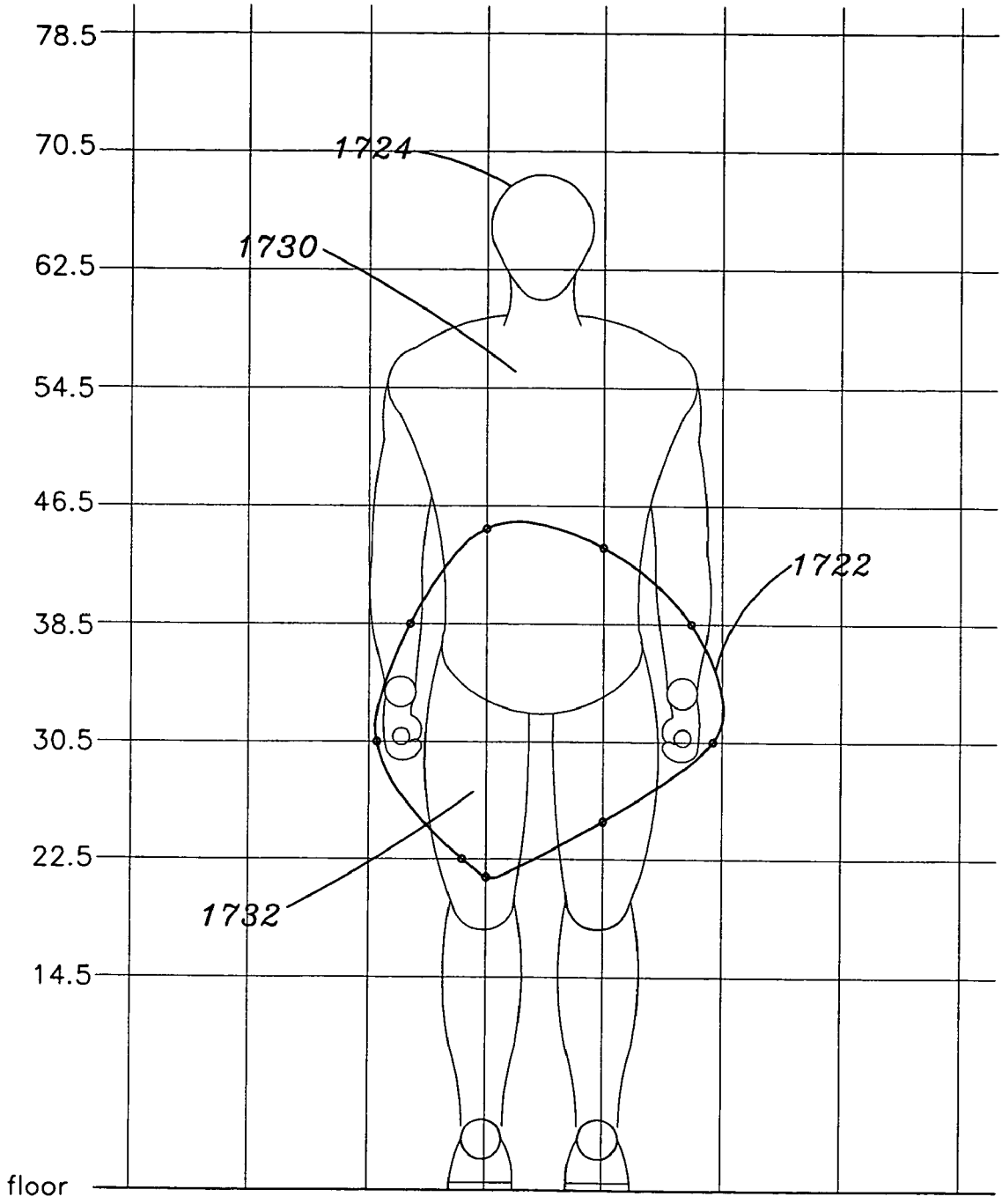
Fig. 17C PRIOR ART

FIGS. 17A, 17B and 17C illustrate comparisons between the exhaust air patterns developed by the present invention, a conventional pedestal fan and a conventional tower fan, respectively. The elongated configuration of the housing and of the outlet opening coupled with the raising of the position of the housing in the home comfort device of the present invention provide an elongated column of exhaust air that can be more effectively focused on the upper body of the user. This provides an improvement over conventional radial type pedestal fans that generally have a relatively wide and disbursed flow of exhaust air and also over conventional tower fans that provide a flow of exhaust air to the lower portion of the user.

FIG. 17A shows exhaust air pattern 1702 developed by the space saving home comfort device of the present invention. Exhaust air pattern 1702 is defined by the area of a flow of exhaust air having a velocity of greater than about 400 feet per minute when measured at approximately 6 feet from the device. The location of exhaust air pattern 1702 relative to user 1704 is on the upper body 1730 of user 1704 is illustrated. As shown, exhaust air pattern 1702 encompasses a width conforming to the width of user 1704, while covering the torso of user 1704.

Figure 1:
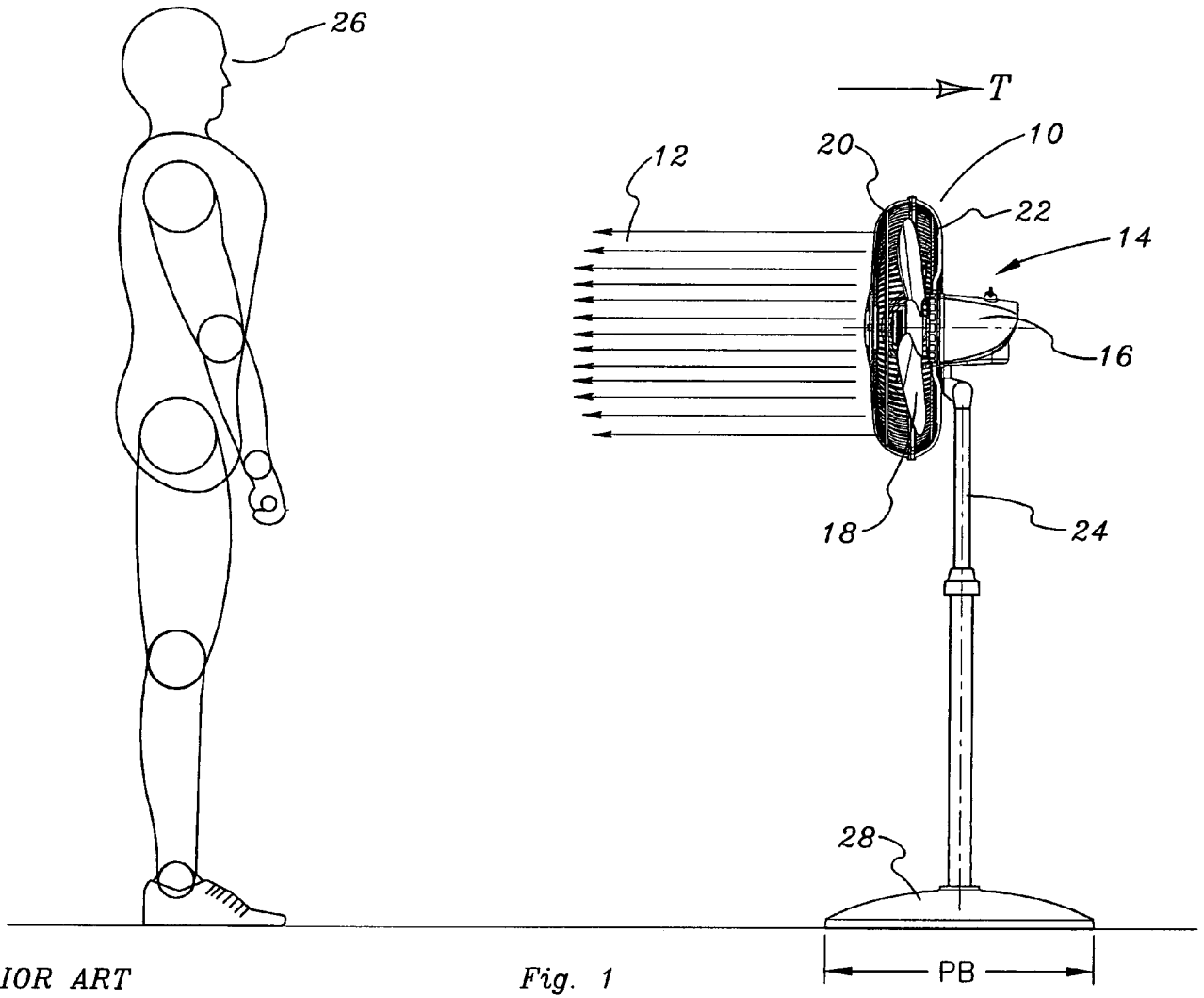
Fig. 1 PRIOR ART
FIG. 1 is an illustration of a conventional pedestal fan.
Figure 2C:
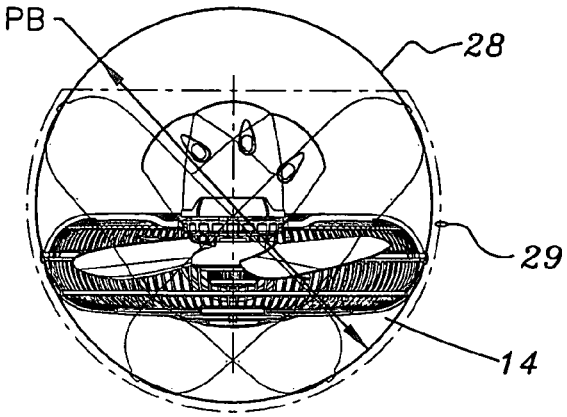
FIGS. 2A, 2B and 2C are various views of the conventional pedestal fan of FIG. 1.
Figure 2A:
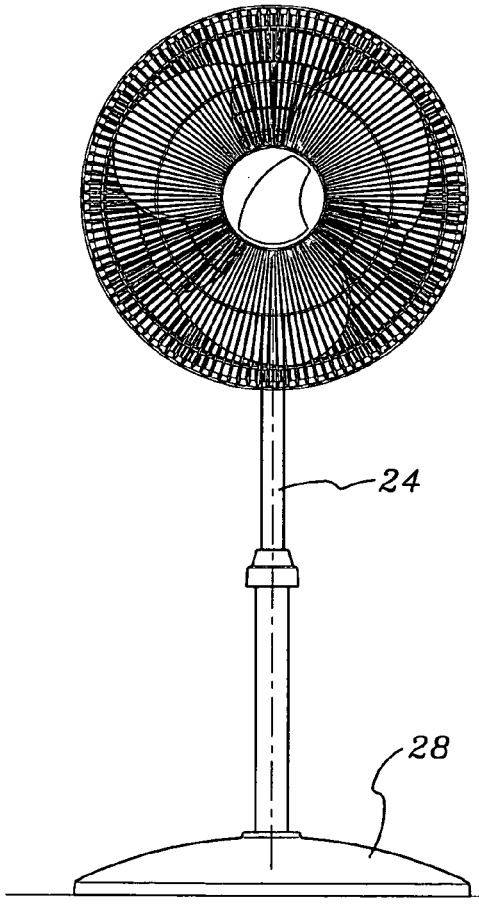
Figure 2B:
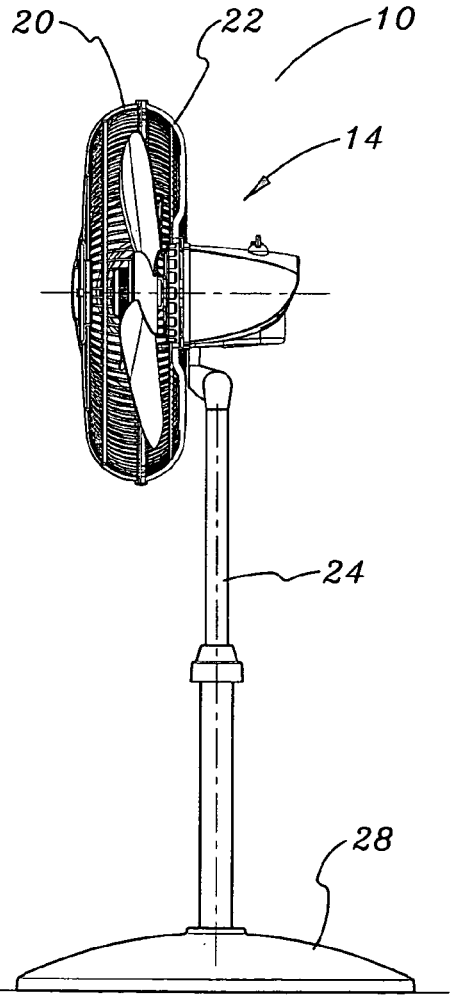

FIG. 17B illustrates exhaust air pattern 1712 developed by conventional pedestal fan 10 (shown in FIG. 1). Exhaust air pattern 1712 is defined by the area of a flow of exhaust air having a velocity of greater than about 400 feet per minute when measured at approximately 6 feet from the device. The location of exhaust air pattern 1712 relative to user 1714 is on the upper body 1730 of user 1714. However, as shown the width of exhaust air pattern 1712 encompasses a substantially greater width than the width of user 1714 and is thus inefficient.

Figures 3A, 3B:
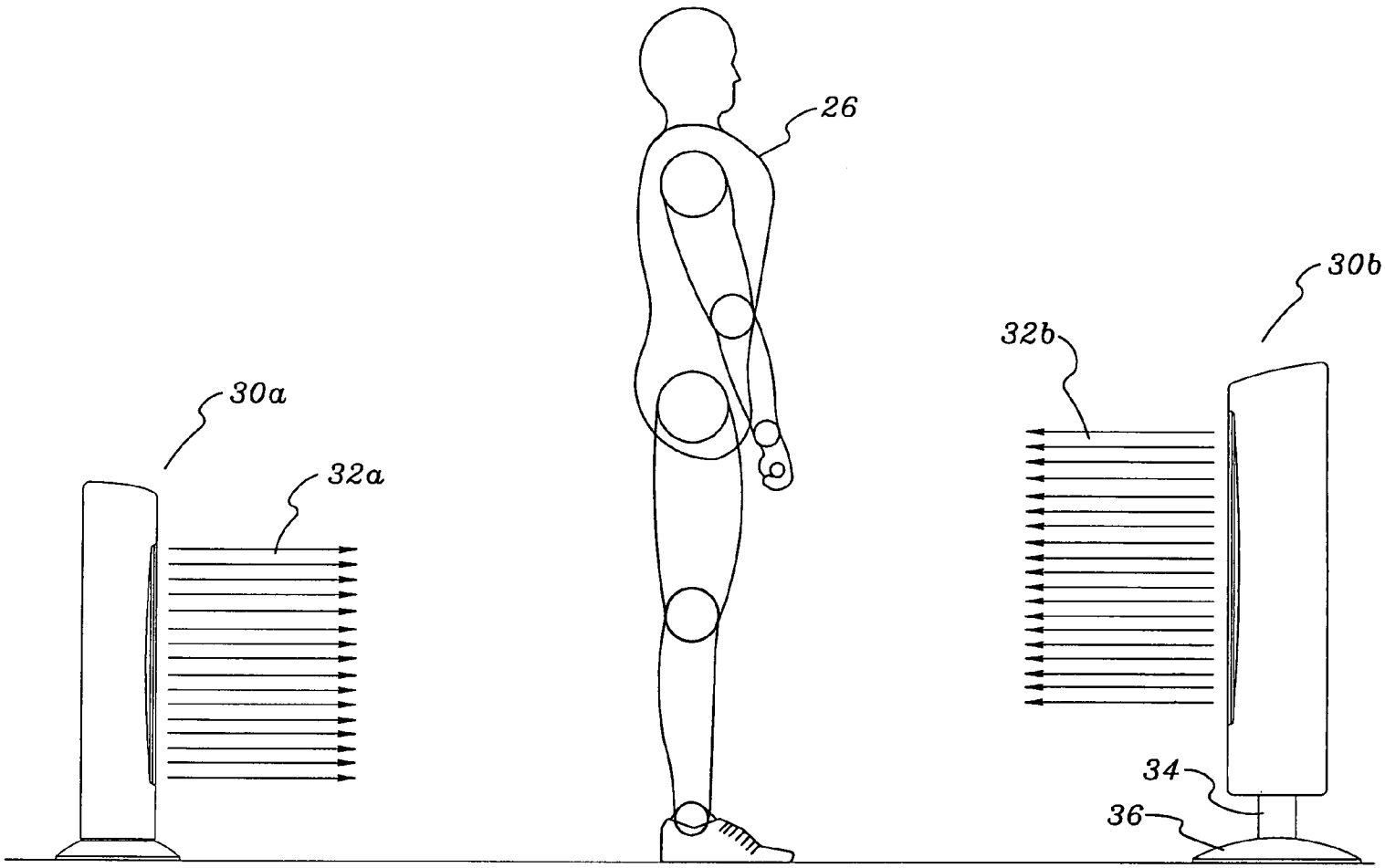
Fig. 3B PRIOR ART
Fig. 3A PRIOR ART
FIGS. 3A and 3B are views of various conventional tower type fans.

FIG. 17C illustrates exhaust air pattern 1722 developed by a conventional tower fan 30*b* (shown in FIG. 3B). Exhaust air pattern 1722 is defined by the area of a flow of exhaust air having a velocity of greater than about 400 feet per minute when measured at approximately 6 feet from the device. The location of exhaust air pattern 1722 relative to user 1724 is on the lower body 1732 of user 1724 and is thus ineffective in providing adequate cooling to user 1732. As shown, the width of exhaust air pattern 1722 encompasses a width slightly wider than the width of user 1724.

A comparison of FIGS. 17A, 17B and 17C illustrates that home comfort device 600 achieves an exhaust air pattern 1702 that more efficiently cools the upper body while maintaining a width that more closely follows the torso of user 1704. These characteristics allow the present invention of the home comfort device to be more efficient when compared to conventional fan designs. The narrow width of exhaust air pattern 1702 requires less energy to develop the desired air velocities when compared to the greater width of exhaust air patterns 1712 of a conventional pedestal fan. The location of exhaust air pattern 1702 more efficiently cools the upper body 1730 of the user when compared to exhaust air pattern 1722 of a conventional tower fan.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. A space saving home comfort device for providing a flow of exhaust air to an upper portion of a user's body at an elevation above a mounting surface comprising:

a base for engaging said mounting surface;

a support column having a first end connected to said base and extending upward from said base to a second end;

an elongate housing connected to said second end of said support column, said housing comprising a bottom, a top, and at least one outer wall extending between said bottom and said top, said housing having a longitudinal length that extends upward from said bottom to said top and having a maximum cross-sectional width taken along a horizontal plane through said housing, wherein said longitudinal length is at least 1.5 times said maximum cross-sectional width;

a rise height defined by a distance from said second end of said support column to said mounting surface, wherein said rise height is at least 40% of said longitudinal length of said housing;

an air inlet and a substantially vertically oriented elongate air outlet in said housing; and an air generator disposed within said housing and in fluid communication with said air inlet and said air outlet, said air generator comprising an air impeller having a substantially vertical axis of rotation.

2. The space saving home comfort device of claim 1, wherein said rise height is at least 12 inches.

3. The space saving home comfort device of claim 1, wherein said longitudinal length of said housing is less than about 30 inches.

4. The space saving home comfort device of claim 1, wherein an overall length of said device is defined by a distance from a bottom of said base to said top of said housing, said overall length being at least 45 inches.

5. The space saving home comfort device of claim 1, wherein said maximum cross-section width of said housing is less than about 90% of said longitudinal length of said housing.

6. The space saving home comfort device of claim 1, wherein said maximum cross-section width of said housing is less than about 12 inches.

7. The space saving home comfort device of claim 1, further comprising a rotator mechanism for moving said housing relative to said base.

8. The space saving home comfort device of claim 7, wherein said rotator mechanism comprises an oscillator for oscillating said housing relative to said base about a substantially vertical axis of rotation.

9. The space saving home comfort device of claim 7, wherein said rotator mechanism comprises a rotator for one of continuous rotating and step-wise rotating said housing relative to said base about a substantially vertical axis of rotation.

10. The space saving home comfort device of claim 7, wherein said rotator mechanism is disposed between one of i) said base and said support column and ii) said support column and said housing.

11. The space saving home comfort device of claim 1, wherein said housing rotates about an axis of rotation, said axis of rotation substantially aligned with a longitudinal axis of said support column.

12. The space saving home comfort device of claim 1, wherein said housing rotates about a first axis of rotation and said air generator has an second rotational axis, said first axis of rotation substantially parallel to said second rotational axis.

13. The space saving home comfort device of claim 1, further comprising:

an area of oscillation defined by an area of movement of said housing about an axis of rotation, a maximum width of said area of oscillation taken along a horizontal plane through said housing; and a base envelope defined by an area taken along a horizontal plane through a lower portion of said base, a maximum width of said base envelope taken along a horizontal plane through said base, wherein said maximum width of said area of oscillation is less than said maximum width of said base envelope.

14. The space saving home comfort device of claim 13, wherein said maximum width of said area of oscillation is less than 70% of said maximum width of said base envelope.

15. The space saving home comfort device of claim 13, wherein said maximum width of said area of oscillation is substantially equal to said maximum cross-sectional width through said housing.

16. The space saving home comfort device of claim 1, wherein said air generator further comprises a high velocity, low thrust blower assembly wherein, said blower assembly includes at least one impeller and generates said flow of exhaust air having a maximum velocity of at least about 400 fpm when measured 6 feet from said housing; and said blower assembly generates a thrust between about 0.1 lbs and about 0.3 lbs in a direction opposite to a direction of said flow of exhaust air to minimize a resultant thrust to allow said base.

17. The space saving home comfort device of claim 16, wherein said flow of exhaust air has an overall area that substantially conforms to a width and a height of a user's torso.

18. The space saving home comfort device of claim 16, wherein the length of said impeller or the combined length of multiple impellers is less than 45% of an overall length of said device, wherein said overall length is defined by a distance from a bottom of said base to said top of said housing.

19. The space saving home comfort device of claim 1, wherein said rise height is between about 40% to about 400% of said longitudinal length of said housing.

20. The space saving home comfort device of claim 1, wherein an overall length of said device is defined by a distance from a bottom of said base to said top of said housing, and said rise height is greater than about 29% of said overall length of said home comfort device.

21. The space saving home comfort device of claim 1, wherein an overall length of said device is defined by a distance from a bottom of said base to said top of said housing, and said rise height is between about 29% and about 80% of said overall length of said home comfort device.

22. The space saving home comfort device of claim 1, wherein an overall length of said device is defined by a distance from a bottom of said base to said top of said housing, and said longitudinal length of said housing is less than about 68% of said overall length of said home comfort device.

23. The space saving home comfort device of claim 1, wherein an overall length of said device is defined by a distance from a bottom of said base to said top of said housing, and said longitudinal length of said housing is between about 20% and about 68% of said overall length of said home comfort device.

24. The space saving home comfort device of claim 1, wherein an overall length of said device is defined by a distance from a bottom of said base to said top of said housing, and said rise height is at least 12 inches, said longitudinal length of said housing is between about 15 inches and about 30 inches, and said overall length of said home comfort device is at least 45 inches.

25. The space saving home comfort device of claim 1, further comprising a minimum set back distance between a leading edge of an impeller of said air generator and an air outlet grill of said housing, wherein said minimum set back distance is at least 20% of a diameter of said impeller.

26. The space saving home comfort device of claim 1, wherein said support column further comprises an adjustable support column for adjusting a height of the housing above said mounting surface.

27. The space saving home comfort device of claim 1, wherein said flow of exhaust air has an overall area that substantially conforms to a width and a height of a user's torso.

28. The space saving home comfort device of claim 1, wherein said support column compnses a maximum cross-sectional width, and wherein said maximum cross-sectional width of said support column is substantially equal to said maximum cross-sectional width of said housing.

29. The space saving home comfort device of claim 1, wherein said support colunm is an extension of said housing.

30. The space saving home comfort device of claim 1, wherein said support column compnses a maximum cross-sectional width, and wherein said maximum cross-sectional width of said support column is greater than said maximum cross-sectional width of said housing.

31. A space saving home comfort device for providing a flow of exhaust air to an upper portion of a user's body at an elevation above a mounting surface comprising:

a base for engaging said mounting surface;

a support column having a first end connected to said base and extending upward from said base to a second end;

a housing connected to said second end of said support column, said housing comprising a bottom, a top, and at least one outer wall extending between said bottom and said top, said housing having a longitudinal length that extends upward from said bottom to said top and having a maximum cross-sectional width taken along a horizontal plane through said housing, wherein said longitudinal length is at least 1.5 times said maximum cross-sectional width;

a rise height defined by a distance from said second end of said support column to said mounting surface, wherein said rise height is at least 40% of said longitudinal length of said housing;

an air inlet and an air outlet in said housing; and a unitary blower assembly disposed within said housing and in fluid communication with said air inlet and said air outlet;

wherein said unitary blower assembly further comprises a centrifugal blower assembly comprising:

a motor having at least one output shaft;

at least one rotating impeller connected to said at least one output shaft; and a cartridge having a scroll casing, an air inlet port, and an air outlet port, wherein said motor and said at least one impeller are housed in said cartridge.

32. The space saving home comfort device of claim 31, wherein said motor and said at least one impeller are pre-assembled in said cartridge, and said pre-assembled cartridge which can be pre-tested and installed in said housing during assembly of said home comfort device.

33. A space saving home comfort device comprising:

a base for stabilizing said home comfort device on a mounting surface;

a housing having an elongated shape, a longitudinal length of said housing being at least 1.5 times a maximum cross-sectional width of said housing taken along a horizontal plane of said housing;

a support column for elevating said housing above said base;

a non-operating configuration when said home comfort device is disassembled for shipment from a place of manufacturing to a place of sale, in said non-operating configuration said home comfort device comprises:

said base disconnected from said support column; and said support column disconnected from said housing;

an operating configuration when said home comfort device is assembled for operation, in said operating configuration said home comfort device comprises:

said base having a maximum cross-sectional width;

said support column having a first end connected to said base and extending upward to a second end;

a rise height defined by a distance from said second end of said support column above a bottom of said base, wherein said rise height is at least 40% of said longitudinal length of said housing; and said housing connected to said second end of said support column, said longitudinal length of said housing extending upward.

34. The space saving home comfort device of claim 33, wherein said base is a split base having at least a first portion and a second portion that can be separated for compact storage in said non-operating configuration and can be assembled as said base in said operating configuration to support said housing on said riser.

35. The space saving home comfort device of claim 33, wherein said support column is a collapsible support column having at least two members, wherein each of said at least two members have substantially the same length and respective different diameters such that each successive smaller diameter member slides into an adjacent member having a larger diameter, wherein in said non-operating configuration said members are collapsed and in said operating configuration said members are adjustable between a minimum length where said members are substantially collapsed and a maximum length wherein said members are extended with respect to one another.

36. The space saving home comfort device of claim 33, wherein said support column further comprises at least two members, wherein each of said at least two members can be separated from one another when said home comfort device is in said non-operating configuration.

37. The space saving home comfort device of claim 33, further comprising an air generator wherein said air generator further comprises one of a transverse blower assembly and/or a unitary blower assembly.

38. The space saving home comfort device of claim 33, further comprising an air generator wherein said air generator comprises a high velocity, low thrust blower assembly, said maximum cross-sectional width of said housing is less than 12 inches and said maximum cross-sectional width of said base is less than 20 inches, said maximum cross-sectional width of said housing is less than said maximum cross-sectional width of said base, said blower assembly generates a flow of exhaust air of at least about 400 fpm, when measured 6 feet from said housing, and said blower assembly generates a low thrust between about 0.1 lbs and about 0.3 lbs in a direction opposite to a direction of said flow of exhaust air to minimize a resultant thrust.

39. The space saving home comfort device of claim 38, wherein said flow of exhaust air has an overall area that substantially conforms to a width and a height of a user's torso.

40. The space saving home comfort device of claim 33, wherein said home comfort device in said operating configuration further comprises said housing, where a maximum cross-sectional width of said housing is less than about 90% of said longitudinal length of said housing.

41. The space saving home comfort device of claim 33, wherein said rise height is between about 40% and about 400% of said longitudinal length of said housing.

42. The space saving home comfort device of claim 33, further comprising an overall length of said home comfort device defined by a distance between a bottom of said base and a top of said housing, wherein said rise height is greater than about 29% of said overall length of said home comfort device.

43. The space saving home comfort device of claim 33, further comprising an overall length of said home comfort device defined by a distance between a bottom of said base and a top of said housing, wherein said rise height is between about 29% and about 80% of said overall length of said home comfort device.

44. The space saving home comfort device of claim 33, further comprising an overall length of said home comfort device defined by a distance between a bottom of said base and a top of said housing, wherein said longitudinal length of housing is less than about 68% of said overall length of said home comfort device.

45. The space saving home comfort device of claim 33, further comprising an overall length of said home comfort device defined by a distance between a bottom of said base and a top of said housing, wherein said longitudinal length of housing is between about 20% and about 68% of said overall length of said home comfort device.

46. The space saving home comfort device of claim 33, further comprising an overall length of said home comfort device defined by a distance between a bottom of said base and a top of said housing, wherein said rise height is at least 12 inches, said longitudinal length of said housing is between about 15 inched and about 30 inches, and said overall length of said home comfort device is at least 45 inches.

47. The space saving home comfort device of claim 33, wherein said home comfort device in said non-operating configuration further comprises a box containing said base, said support column, and said housing, wherein said box has a length less than about 23 inches, a width less than about 9 inches, and a height of less than about 9 inches.

48. The space saving home comfort device of claim 33, further comprising an air generator disposed within said housing.

49. The space saving home comfort device of claim 48, wherein said air generator comprises a unitary blower assembly, said unitary blower assembly further comprising a centrifugal blower assembly including i) a motor having at least one output shaft; ii) at least one rotating impeller connected to said at least one output shaft; and iii) a cartridge having a scroll casing, an air inlet port, and an air outlet port, said motor and said at least one impeller being housed in said cartridge.

50. The space saving home comfort device of claim 49, wherein said motor and said at least one impeller are pre-assembled in said cartridge, and said pre-assembled cartridge is pre-tested and installed in said housing during assembly of said home comfort device from said non-operating configuration to said operating configuration.

51. The space saving home comfort device of claim 33, further comprising an air generator, wherein said air generator is used to generate a flow of exhaust air, said flow of exhaust air having an overall area that conforms to a width and a height of a user's torso.

52. A space saving home comfort device comprising:

a base for stabilizing said home comfort device on a mounting surface;

a housing having an elongated shape, a longitudinal length of said housing being at least 1.5 times a maximum cross-sectional width of said housing taken along a horizontal plane of said housing;

a support column for elevating said housing above said base;

wherein said support column and said base are combined into a single support member;

a non-operating configuration when said home comfort device is disassembled for shipment;

wherein said support member is decoupled from said housing and said housing is disposed within said support member in said non-operating configuration for shipment;

an operating configuration when said home comfort device is assembled for operation, in said operating configuration said home comfort device comprises:

said support member extending upward from said mounting surface to a second end;

a rise height defined by a distance from said second end of said support member above a bottom of said base, wherein said rise height is at least 40% of said longitudinal length of said housing; and said housing connected to said second end of said support member, said longitudinal length of said housing extending upward.

53. The space saving home comfort device of claim 52, wherein said support member further comprises more than one component assembled together to form said support member.

54. A space saving home comfort device for providing a flow of air to an upper portion of a user's body at an elevation above a mounting surface comprising:

a base for engaging said mounting surface;

a support column having a first end connected to said base and extending upward from said base to a second end;

a housing connected to said second end of said support column, said housing comprising a bottom, a top, and at least one outer wall extending between said bottom and said top, said housing having a longitudinal length of less than 30 inches extending upward from said bottom to said top and having a maximum cross-sectional width taken along a horizontal plane through said housing, wherein said longitudinal length is at least 1.5 times said maximum cross-sectional width;

a rise height of at least 12 inches defined by a distance from said second end of said support column to said mounting surface, wherein said rise height is at least 40% of said longitudinal length of said housing;

an air inlet and an air outlet in said housing;

an air generator disposed within said housing and in fluid communication with said air inlet and said air outlet, said air generator providing exhaust air having an overall area when measured at six feet from said housing that conforms to a width and a height of a user's torso; and an overall length defined by a distance from a bottom of said base to said top of said housing, said overall length being at least 45 inches, wherein said housing rotates about a first axis of rotation and said air generator has an second rotational axis, said first axis of rotation substantially parallel to said second rotational axis.

* * * * *